US007453423B2

(12) United States Patent
Mizobata

(10) Patent No.: US 7,453,423 B2
(45) Date of Patent: Nov. 18, 2008

(54) PLASMA DISPLAY AND DRIVE METHOD FOR USE ON A PLASMA DISPLAY

(75) Inventor: Eishi Mizobata, Tokyo (JP)

(73) Assignee: Pioneer Corporation, Tokyo (JP)

( * ) Notice: Subject to any disclaimer, the term of this patent is extended or adjusted under 35 U.S.C. 154(b) by 470 days.

(21) Appl. No.: 11/229,842

(22) Filed: Sep. 20, 2005

(65) Prior Publication Data

US 2006/0066518 A1 Mar. 30, 2006

(30) Foreign Application Priority Data

Sep. 21, 2004 (JP) ..... 2004-273718

(51) Int. Cl.
*G09G 3/28* (2006.01)

(52) U.S. Cl. ..... 345/63; 345/60; 345/66; 345/67; 345/68

(58) Field of Classification Search ..... 345/60–69, 345/37, 41; 313/169.1–169.4
See application file for complete search history.

(56) References Cited

U.S. PATENT DOCUMENTS

2005/0253517 A1* 11/2005 Kwon et al. ..... 313/586
2005/0264491 A1* 12/2005 Choi ..... 345/67
2006/0158113 A1* 7/2006 Hur et al. ..... 313/582
2006/0170630 A1* 8/2006 Hur et al. ..... 345/77

FOREIGN PATENT DOCUMENTS

JP 2002/006805 1/2002
JP 2002/006806 1/2002

* cited by examiner

*Primary Examiner*—Vijay Shankar
(74) *Attorney, Agent, or Firm*—Drinker Biddle & Reath LLP

(57) ABSTRACT

A plasma display improved in variation of display brightness between unit cells. A control circuit sets, for every pulse, a charge-recovering time period for recovering a charge on a capacitance component of the plasma display panel and a clamp timing period for applying a predetermined sustain voltage to the sustain electrodes or the scan electrodes after the charge-recovering time period through clamp start timing, and sets a sustain-discharge emission intensity ratio, as a ratio of a maximal discharge intensity in the clamp timing period with reference to a discharge intensity in the clamp start timing to a maximum discharge intensity in the charge-recovering time period, at a value that a discharge in the clamp timing period is to spread up to an end of the unit cell. For example, the control circuit sets a sustain-discharge emission intensity ratio substantially at 0.5 or greater or 0.1 or smaller, thus eliminating the occurrence of image retention.

20 Claims, 21 Drawing Sheets

PRINT PATTERN OF IMAGE RETENTION

IMAGE RETENTION INTENSITY RATIO
EVALUATION PATTERN

PLASMA DISPLAY AND DRIVE METHOD FOR USE ON A PLASMA DISPLAY

BACKGROUND OF THE INVENTION

1. Field of the Invention

This invention relates to a plasma display and a drive method for use on a plasma display, and more particularly to a plasma display and a drive method for use on a plasma display which are suitably used in improving the variations in brightness of display in a plasma display panel.

2. Description of the Related Art

The plasma display, including a plasma display panel (hereinafter, referred also to as "PDP") as its major part, has many features, e.g. sliminess and relative easiness to make a large-screen display, wide viewing angle, high response speed and so on. Consequently, it is a recent practice to make use of it as a flat panel display, in a wall-mounted TV and a communal display.

The plasma displays are classified into a certain number of kinds depending upon the operation schemes thereof. The PDPs, manufactured presently on a commercial basis, adopts "Address Display Separate method (ADS)" in which completely separated are a scanning time period for writing display data to the cell and a sustaining time period for effecting display by an actual discharge. In the Address Display Separate method, after all the display data is written in the scanning time period, on-screen display is performed by applying a sustain pulse simultaneously to all the cells in the sustaining time period, thus simplifying the internal circuit to a comparative extent. Besides, drive margin is easy to secure because of no coexistence, on the panel, of a write discharge for writing display data to the cell and a sustain discharge for making a display at the same time. By virtue of those merits, the Address Display Separate method is adopted in the existing plasma displays.

The plasma display of this kind is conventionally constructed with a display panel (PDP) 1, a data driver 11, a scanning driver 12, a sustain driver 13, a charge recovering circuit 14, a power supply circuit 15, a signal processing circuit 21 and a control circuit 22, as shown in FIG. 1 for example. The PDP 1 has front and back substrates, not shown, arranged opposed to each other. On an opposed surface of the front substrate to the back substrate, scan electrodes 2 and sustain electrodes 3 are arranged parallel one with another with a spacing of a not-shown discharge gap. Scan pulses for write discharge are sequentially applied to the scan electrode 2. Meanwhile, the scan electrodes 2 and the sustain electrodes 3 constitute pairs of-surface-discharge electrodes, to which a sustain pulse is applied to cause a sustain discharge. On the opposed surface of the back substrate to the front substrate, a plurality of data electrodes 4 are provided in the form intersecting with the surface-discharge electrodes. A data pulse and erase-data pulse are applied to the data electrodes 4. Unit cells 5 are formed at the intersections of the surface-discharge electrode pairs and the data electrodes 4.

The data driver 11 is to apply a data pulse and erase-data pulse corresponding to display data z to the data electrode 4. The scanning driver 12 is to apply a scan pulse and erase pulse to the scan electrode 2. The sustain driver 13 is to apply a sustain pulse to the sustain electrode 3. The charge recovering circuit 14 is to restore the capacitance component charge of the PDP 1 and establish a potential on the scan electrode 2 and sustain electrode 3 of the PDP 1, under control of the control circuit 22.

The power supply circuit 15 is to supply a predetermined high-voltage power to the data driver 11, the scanning driver 12, the sustain driver 13 and the charge recovering circuit 14. The signal processing circuit 21 is configured by a not-shown A/D (analog/digital) conversion circuit, pixel conversion circuit, sub-field conversion circuit and so on. An analog video signal "in" is converted into a digital video signal by the AD conversion circuit, the number of pixels of the video signal is converted into the number of pixels corresponding to the PDP 1 by the pixel conversion circuit to thereby generate a video signal, and the video signal of from the pixel conversion circuit is converted into sub-field-based display data z by the sub-field conversion circuit and forwarded to the data driver 11. The control circuit 22 takes control of the operation timing of the data driver 11, the scanning driver 12, the sustain driver 13 and the charge recovering circuit 14, to thereby control the input of a voltage generated by the power supply circuit 15. Timing signals (horizontal synchronizing signal, vertical synchronizing signal) H, V are inputted to the signal processing circuit 21 and control circuit 22, to take a synchronism of the operation thereof with a screen displayed.

FIG. 2 is a structural view showing the major part of the PDP 1 in FIG. 1.

In the PDP 1, there are arranged a group of surface-discharge electrodes formed with scan electrodes 2 (Scani, i=1, 2, . . . , n) and sustain electrodes 3 (Susi, i=1, 2, . . . , n) that are in the number of n and are extending in a row direction H and arranged parallel one with another on an inner surface of a not-shown front substrate, and data electrodes 4 (Dj, j=1, 2, . . . , m) which are in the number of m and are arranged extending along a column direction V and orthogonally to the surface-discharge electrode group on an inner surface of a not-shown back substrate. Unit cells 5 are respectively formed at the intersections of the surface-discharge electrode group and the data electrodes 4. Thus, cells are arranged in a matrix form in the row direction H and the column direction V. For monochromatic display, one cell constitutes one pixel whereas, for color display, one pixel is constituted by three cells (emission cells for red R, green G and blue B).

FIG. 3 is a cross-sectional view of the unit cell 5 taken on line A-A in FIG. 2.

In the unit cell 5, a front substrate 11 and a back substrate 12 are oppositely arranged with a predetermined spacing, as shown in FIG. 3. The front substrate 11 is structured by a glass substrate or the like, on which front substrate 11 a scan electrode 2 and a sustain electrode 3 are arranged spaced with a discharge gap 13. Those scan electrode 2 and sustain electrode 3 constitute a surface-discharge electrode pair 6. Furthermore, a transparent dielectric layer 14 is formed over those electrodes, and a protection layer 15 is formed on the transparent dielectric layer 14. The protection layer 15 is structured of MgO or the like, thus protecting the transparent dielectric layer 14 from a discharge. Meanwhile, the back substrate 12 is structured by a glass substrate, on which back substrate 12 the data electrode 4 is provided orthogonally to the scan electrode 2 and sustain electrode 3. Furthermore, a white dielectric layer 16 is provided over the data electrode 4, on which white dielectric layer 16 a phosphor layer 17 is provided. Between the front substrate 11 and the back substrate 12, a curb-formed partition wall 18 is formed in a manner surrounding the cell. The partition wall 18 serves to secure a discharge space 19 and demarcate pixels. The discharge space 19 is sealed therein with a mixture gas of He, Ne, Xe or the like as a discharge gas.

FIG. 4 is a circuit diagram showing an electric configuration of the PDP 1 and charge recovering circuit 14 in FIG. 1.

The charge recovering circuit 14 is configured with a resonant circuit 30 and clamping circuits 40, 50, as shown in FIG. 4. The resonant circuit 30 is configured with an inductance 31, a diode 32, switches S1, S2, a diode 33 and an inductance 34. In the resonant circuit 30, the switches S1, S2 are controlled as to on/off state by the control circuit 22. When the inductance 31 or inductance 34 and the capacitance component of PDP 1 become a resonant state, the charge on the capacitance component of PDP 1 is restored by the inductance 31 or 34.

The clamping circuit 40 is configured with switches S3, S4 and diodes 41, 42. In the clamping circuit 40, the switches S3, S4 are controlled as to on/off state by the control circuit 22, to set the scan electrode 2 of PDP 1 at a voltage Vs or a ground level. The clamping circuit 50 is configured with switches S5, S6 and diodes 51, 52. In the clamping circuit 50, the switches S5, S6 are controlled as to on/off state by the control circuit 22, to set the sustain electrode 3 of PDP 1 at a voltage Vs or a ground level.

FIG. 5 is a circuit diagram showing another electric configuration of the charge recovering circuit 14 in FIG. 1.

The charge recovering circuit 14 is configured with resonant circuits 60, 70 and clamping circuits 80, 90, as shown in FIG. 5. The resonant circuit 60 is configured with an inductance 61, a diode 62, switches S1, S2, a diode 63, an inductance 64 and a capacitance 65. In the resonant circuit 60, the switches S1, S2 are controlled as to on/off state by the control circuit 22. When the inductance 61 or inductance 64, the capacitor 65 and the capacitance component of PDP 1 become a resonant state, the charge on the capacitance component of PDP 1 is restored by the capacitor 65.

The resonant circuit 70 is configured with an inductance 71, a diode 72, switches S3, S4, a diode 73, an inductance 74 and a capacitance 75. In the resonant circuit 70, the switches S3, S4 are controlled as to on/off state by the control circuit 22. When the inductance 71 or inductance 74, the capacitor 75 and the capacitance component of PDP 1 become a resonant state, the charge on the capacitance component of PDP 1 is restored by the capacitor 75.

The clamping circuit 80 is configured with switches S5, S6 and diodes 81, 82. In the clamping circuit 80, the switches S5, S6 are controlled as to on/off state by the control circuit 22, to set the scan electrode 2 of PDP 1 at a voltage Vs or a ground level. The clamping circuit 90 is configured with switches S7, S8 and diodes 91, 92. In the clamping circuit 90, the switches S7, S8 are controlled as to on/off state by the control circuit 22, to set the scan electrode 2 of PDP 1 at a voltage Vs or a ground level.

FIG. 6 is a figure explaining the principle of gradation display method according to the Address Display Separate method for use on the PDP of FIG. 2, wherein time is taken on the abscissa while in-PDP scan electrode number (1, . . . , n) is taken on the ordinate.

In the PDP, one field TF is segmented into six sub-fields 1SF, 2SF, . . . , 6SF weighted based on the intensity level, as shown in FIG. 6. Each sub-field is segmented into an initializing time period (referred also to as "preparatory discharge time period") T1, a scanning time period T2 and a sustaining time period T3. The slant line within each scanning time period T2 represents the timing of a scan pulse to be applied line-sequentially to the scan electrode 2. In case the scan pulse and the data pulse, to be applied to the data electrode 4, are both applied simultaneously, a write discharge takes place. The sustaining time period T3 is a time period for which the unit cell 5 is caused for display-emission.

In the sustaining time period T3, sustain pulses are applied alternately to the scan electrode 2 and the sustain electrode 3. In the cell in which a discharge occurs in the scanning time period T2, emission takes place at an intensity commensurate with the length of the sustaining time period T3 (i.e. the number of sustain pulses). In FIG. 6, the sub-fields 1SF, 2SF, . . . , 6SF have respectively sustaining time periods T3 set in length ratio of 1:2:4:8:16:32 and therefore by combining the respective emissions in the sustaining time periods T3, on-screen display is performed with 64 levels (0-63) of intensities. For example, where to make on-screen display at 29-th intensity level, control is made to cause an emission in sub-field 1SF (level: 1), sub-field 3SF (level: 4), sub-field 4SF (level: 8) and sub-field 5SF (level: 16) in a period of one field TF.

FIG. 7 is a figure showing an essential part of a drive waveform for use in the Address Display Separate method.

Referring to the figure, explanation is made on the drive method according to the Address Display Separate method.

The sustain electrode 3 is applied with a voltage shown as a waveform Sus, as shown in FIG. 7, while the scan electrode 2 is sequentially applied with a voltage shown as wavefors Scan1–Scann. Meanwhile, the data electrode 4 is applied with a voltage shown as a waveform Data. In the initializing time period T1, a sustain erase waveform-b is applied to the scan electrode 2. Initialization (reset) is made as to the difference in formation amount of wall charge that is a charge built up, by discharge, on a dielectric layer (transparent dielectric layer 14 and white dielectric layer 16) over each electrode within the unit cell 5 due to the presence/absence of a sustain discharge in the preceding sub-field. Meanwhile, in the initializing time period T1, a priming effect occurs which is for facilitating a discharge in line-sequentially writing data depending upon display data in the scanning time period T2 subsequent to the initializing time period T1, and further the wall charge is made in a state optimal for write discharge. In this case, a priming waveform-c and priming erase waveform-d are applied to the scan electrode 2. By the priming waveform-c, a weak discharge takes place regardless of occurrence/non-occurrence of a sustain discharge in the preceding sub-field. The occurrence of a priming particle within the discharge space 19 results in a status a write discharge is ready to occur.

In the scanning time period T2, video information is written to the unit cells 5 by changing the status of wall charge depending upon the presence/absence of a write discharge occurrence, sequentially on a scan-electrode 2 basis and correspondingly to a video signal "in". Namely, in the scanning time period T2, a scan pulse-a is sequentially applied to Scan1, Scan2, . . . , Scann of the scan electrodes 2 being applied with a scanning-base voltage Vbw. In accordance with the scan pulse-a, a data pulse-e is applied to D1, D2, . . . , Dm of the data electrodes 4 according to a display pattern. Incidentally, the slant line on the data pulse in FIG. 7 represents that a data pulse-e is applied or not applied according to the video signal. In the on-cell, a data pulse-e is applied during the application of a scan pulse-a, to cause a write discharge. Meanwhile, in the off-cell, a data pulse-e is not applied not to cause a write discharge. After applying the scan pulse-a to all the scan electrodes 2, transition is into a sustaining time period T3.

In the sustaining time period T3, a sustain pulse f at voltage Vs is applied alternately to all the scan electrodes 2 and all the sustain electrodes 3. In the on-cell where a write discharge occurred, a sustain discharge is caused by the wall charge formed upon the write discharge. Once a sustain discharge takes place, the wall charge is inverted in polarity to invert the polarity of the sustain pulse-f, thereby causing a sustain discharge again. Each time the sustain pulse inverts in polarity, a sustain discharge is caused to make on-status.

FIG. 8 is a waveform diagram explaining the operations of various points in FIG. 7 in the sustaining time period T3 where the FIG. 1 charge recovering circuit 14 is in a configuration shown in FIG. 4.

In (a) and (b) of FIG. 8, there is shown a magnified drive waveform in the sustaining time period T3 while, in (c) of FIG. 8, there is shown a visible-light emission waveform of a sustain discharge.

Namely, a sustain pulse-f has a charge-recovering time period T31, a clamp timing period T32, a charge-recovering time period T33, and a clamp timing period T34. In the charge-recovering time period T31, the switch S1 of the resonant circuit 30 is on in state so that voltages mutually reverse in phase are applied from the resonant circuit 30 to the scan electrode 2 and the sustain electrode 3. In the clamp timing period T32, the switch S3 of the clamping circuit 40 is on in state so that a voltage Vs is applied from the clamping circuit 40 to the scan electrode 2. Furthermore, the switch S6 of the clamping circuit 50 is on in state so that the sustain electrode 3 is at a ground level. In the charge-recovering time period T33, the switch S2 of the resonant circuit 30 is on in state so that mutually-reverse voltages are applied from the resonant circuit 30 to the scan electrode 2 and the sustain electrode 3. In the clamp timing period T34, the switch S4 of the clamping circuit 40 is on in state so that the scan electrode 2 is at a ground level. Furthermore, the switch S5 of the clamping circuit 50 is on in state so that a voltage Vs is applied from the clamping circuit 50 to the sustain electrode 3.

The start timing t31, t32 in entering the clamp timing period T32, T43 is referred to as clamp start timing while the time of the charge-recovering time period T31, T33 is referred to as a recovering time. In the charge-recovering time period T31, T33, the resonance of the resonant circuit 30 and the cell 5 capacitance component of PDP 1 causes the charge built up on the capacitance component to flow to the scan electrode 2 and sustain electrode 3 thereby causing voltage application. Hence, those are not fixed at particular potentials. Accordingly, as shown in (a) and (b) of FIG. 8, once a sustain discharge begins, the charge flowed to the scan electrode 2 and sustain electrode 3 decreases to decrease the application voltage. Due to this, the sustain discharge once changes toward weakening. However, when voltage is applied from the clamping circuit 40, 50 to the scan electrode 2 and sustain electrode 3 in the clamp start timing t31, t32, the application voltage increases at once and hence change is toward intensification again. For this reason, there is a change in the emission waveform around the clamp start timing t31, t32.

FIG. 9 is a waveform diagram explaining the operations at various points in FIG. 7 in the sustaining time period T3 wherein the FIG. 1 charge recovering circuit 14 is in a configuration shown in FIG. 5.

In (a) and (b) of FIG. 9, there is shown a magnified drive waveform in the sustaining time period T3 while, in (c) of FIG. 9, there is shown a visible-light emission waveform of a sustain discharge.

Namely, the sustain pulse-f on the scan electrode 2 has a clamp timing period T41, a charge-recovering time period T42, a clamp timing period T43, A charge-recovering time period T44 and a clamp timing period T45. The sustain pulse-f on the sustain electrode 3 has a charge-recovering time period T51, a clamp timing period T52, a charge-recovering time period T53 and a clamp timing period T54.

The switch S1 of the resonant circuit 60 is on in state in the charge-recovering time period T42 and clamp timing period T43. The switch S2 of the resonant circuit 60 is on in state in the charge-recovering time period T44 and clamp timing period T45. The switch S3 of the resonant circuit 70 is on in-state in the clamp timing period T41, charge-recovering time period T42 and clamp timing period T43. The switch S4 of the resonant circuit 70 is on in state in the charge-recovering time period T53 and clamp timing period T54. The switch S5 of the clamping circuit 80 is on in state in the clamp timing period T43. The switch S6 of the clamping circuit 80 is on in state in the clamp timing period T45. The switch S7 of the clamp circuit 90 is on in state in the clamp timing period T54. The switch S8 of the clamp circuit 90 is on in state in the clamp timing period T52.

For this reason, there encounters a deviation in rise/fall timing in voltages to be applied respectively to the scan electrode 2 and the scan electrode 3, as shown in (a) and (b) in FIG. 9. However, a sustain discharge occurs in the course of the charge-recovering time period T42. The sustain discharge continues straddling the clamp start timing t41. The discharge is once weakened immediately before the clamp start timing t41 and again intensified immediately after the clamp start timing t41. Thus, the emission waveform is nearly similar to that of (c) in FIG. 8, as shown in (c) in FIG. 9.

Besides the plasma display in the above, the art of this kind conventionally includes those of description in the following document, for example.

JP-A-2000-172223 (Abstract, FIG. 1) describes a drive method for a plasma display panel. By allowing a variation between the time from beginning of a charge restoration to fixing to a sustain potential with respect to the sustain pulse and the time from beginning of charge restoration to fixing to a ground potential, a predetermined brightness is obtained when the load of display is great. When the load of display is low, brightness saturation does not occur.

However, the foregoing plasma display involves the following problem.

Namely, in the unit cell 5 of the PDP 1, there is a variation in the discharge initiating threshold voltage, as a minimal application voltage for causing a discharge on the surface-discharge electrode 6, due to the variation in length of the discharge gap 13 and in thickness of the transparent dielectric layer 14 and white dielectric layer 16. Meanwhile, there is a possibility that discharge initiating threshold voltage temporarily differs between the cells having, in nature, the same discharge initiating threshold voltage characteristic, depending upon the immediately preceding state of display (on or off). In case the discharge initiating threshold voltage is different between the unit cells, the emission waveform shown in (c) of FIG. 8 or (c) of FIG. 2 is made different on a unit-cell-5 basis. This makes different on-screen brightness between the unit cells 5, resulting in a problem of a deterioration in the quality of display screen.

Meanwhile, the drive method for a plasma display, described in JP-A-2000-172223, aims at improving the problem that required brightness is not obtainable when the load of display is great while brightness saturation occurs when the load of display is small. This is different in gist from the present invention.

SUMMARY OF THE INVENTION

This invention has been made in view of the foregoing circumstances, and it is an object thereof to provide a plasma display free from deterioration in display screen quality even where there is variation in discharge initiating threshold voltage among unit cells.

In order to solve the above problem, a plasma display according to a first feature of the invention comprises a plasma display panel; and a driving section for driving the plasma display panel by segmenting one field of display screen into a plurality of sub-fields weighted based on intensity level; the plasma display panel having first and second substrates arranged opposite to each other; a plurality of surface-discharge electrode pairs formed with scan electrodes and sustain electrodes that are arranged parallel one with another with a discharge gap, on an opposed surface of the first substrate to the second substrate; a plurality of data electrodes provided in a form intersecting with the surface-discharge electrode pairs, on an opposed surface of the second substrate to the first substrate; a plurality of unit cells formed at intersections of the plurality of surface-discharge electrode pairs and the plurality of data electrodes; a discharge gas filled between the first substrate and the second substrate, including an interior of the unit cells; a first dielectric layer covering the plurality of surface-discharge electrode pairs; and a second dielectric layer covering the plurality of data electrodes. The driving section sets a scanning time period for applying, line-sequentially for every sub-field, a scan pulse to the scan electrodes and, simultaneously, applying a display data pulse synchronous with the scan pulse to the data electrodes, thereby selecting the unit cells and causing a write discharge in the selected unit cells and a sustaining time period for applying a sustain pulse alternately to the sustain electrodes and the scan electrodes and causing a sustain discharge within the unit cells. A sustain discharge emission intensity ratio control section is provided to set, for every pulse, a charge-recovering time period for recovering a charge on a capacitance component of the plasma display panel and a clamp timing period for applying a predetermined sustain voltage to the sustain electrodes or the scan electrodes after the charge-recovering time period through clamp start timing, and to set a sustain discharge emission intensity ratio, as a ratio of a maximal discharge intensity in the clamp timing period with reference to a discharge intensity in the clamp start timing to a maximum discharge intensity in the charge-recovering time period, at a value that a discharge in the clamp timing period is to spread up to an end of the unit cell.

A plasma display in a second embodiment of the invention, according to the plasma display in the first or second embodiment of the invention, is that the sustain discharge emission intensity ratio control section is configured to set the sustain discharge emission intensity ratio substantially at 0.5 or greater or 0.1 or smaller.

A plasma display in a third embodiment of the invention, according to the plasma display in the first or second embodiment of the invention, is that the sustain discharge emission intensity ratio control section is configured to control the sustain discharge emission intensity ratio correspondingly to an image retention intensity ratio as a ratio of a luminance at a point where luminance changed by image retention to a luminance at a point on the plasma display panel where there are no image retention of a display pattern.

A plasma display in a fourth embodiment of the invention, according to the plasma display in the first or second embodiment of the invention, is that the sustain discharge emission intensity ratio control section is configured to control the sustain discharge emission intensity ratio correspondingly to a load of display over the sub-fields.

A plasma display in a fifth embodiment of the invention, according to the plasma display in the first or second embodiment of the invention, is that the sustain discharge emission intensity ratio control section is configured to control the sustain discharge emission intensity ratio correspondingly to a change in discharge initiating threshold voltage for the unit cells.

A plasma display in a sixth embodiment of the invention, according to the plasma display in the first or second embodiment of the invention, is that the sustain discharge emission intensity ratio control section is configured to control the sustain discharge emission intensity ratio correspondingly to an ambient environmental temperature of the plasma display.

A plasma display in a seventh embodiment of the invention, according to the plasma display in the first or second embodiment of the invention, is that the sustain discharge emission intensity ratio control section is configured to control the sustain discharge emission intensity ratio correspondingly to a time of use of the plasma display from a start of use thereof.

A plasma display in an eighth embodiment of the invention, according to the plasma display in the fourth embodiment of the invention, is that the sustain discharge emission intensity ratio control section is configured to set the sustain discharge emission intensity ratio substantially at 0.5 or greater or 0.1 or smaller when the load of display over the sub-fields is 100%.

A plasma display in a ninth embodiment of the invention, according to the plasma display in any of the first to eighth embodiments of the invention, is that the sustain discharge emission intensity ratio control section is configured to control the sustain discharge emission intensity ratio by changing the clamp start timing in a position-in-time.

A plasma display in a tenth embodiment of the invention, according to the plasma display in any of the first to eighth embodiments of the invention, is that the sustain discharge emission intensity ratio control section has an inductance for recovering a charge on a capacitance component of the plasma display panel, and is configured to control the sustain discharge emission intensity ratio by changing the inductance.

A plasma display according to an eleventh feature of the invention comprises a plasma display panel; and a driving section for driving the plasma display panel by segmenting one field of display screen into a plurality of sub-fields weighted based on intensity level; the plasma display panel having first and second substrates arranged opposite to each other; a plurality of surface-discharge electrode pairs formed with scan electrodes and sustain electrodes that are arranged parallel one with another with a discharge gap, on an opposed surface of the first substrate to the second substrate; a plurality of data electrodes provided in a form intersecting with the surface-discharge electrode pairs, on an opposed surface of the second substrate to the first substrate; a plurality of unit cells formed at intersections of the plurality of surface-discharge electrode pairs and the plurality of data electrodes; a discharge gas filled between the first substrate and the second substrate including the interior of the unit cells; a first dielectric layer covering the plurality of surface-discharge electrode pairs; and a second dielectric layer covering the plurality of data electrodes. The driving section sets a scanning time period for applying, line-sequentially for every sub-field, a scan pulse to the scan electrodes and, simultaneously, applying a display data pulse synchronous with the scan pulse to the data electrodes, thereby selecting a unit cell and causing a write discharge, and a sustaining time period for applying a sustain pulse alternately to the sustain electrodes and the scan electrodes and causing a sustain discharge within the unit cells. A sustain discharge emission intensity ratio control section is provided to set, for every pulse, a charge-recovering time period for recovering a charge on a capacitance component of the plasma display panel and a clamp timing period for applying a predetermined sustain voltage to the sustain electrodes or the scan electrodes after the charge-recovering time period through clamp start timing, and to set a sustain discharge emission crest value ratio, as a ratio of a crest value of a discharge emission waveform in the clamp timing period to a crest value of a discharge emission waveform in the charge-recovering time period, smaller than 1.

A plasma display in a twelfth embodiment of the invention, according to the plasma display in the eleventh embodiment of the invention, is that the sustain discharge emission intensity ratio control section is configured to control the sustain discharge emission intensity ratio correspondingly to an image retention intensity ratio as a ratio of a luminance at a point where luminance changed by image retention to a luminance at a point on the plasma display panel where there are no image retention of a display pattern.

A plasma display in a thirteen embodiment of the invention, according to the plasma display in the eleventh embodiment of the invention, is that the sustain discharge emission intensity ratio control section is configured to control the sustain discharge emission intensity ratio correspondingly to a load of display over the sub-fields.

A plasma display in a fourteenth embodiment of the invention, according to the plasma display in the eleventh embodiment of the invention, is that the sustain discharge emission intensity ratio control section is configured to control the sustain discharge emission intensity ratio correspondingly to a change in discharge initiating threshold voltage for the unit cells.

A plasma display in a fifteenth embodiment of the invention, according to the plasma display in the eleventh embodiment of the invention, is that the sustain discharge emission intensity ratio control section is configured to control the sustain discharge emission intensity ratio correspondingly to an ambient environmental temperature of the plasma display.

A plasma display in a sixteenth embodiment of the invention, according to the plasma display in the eleventh embodiment of the invention, is that the sustain discharge emission intensity ratio control section is configured to control the sustain discharge emission intensity ratio correspondingly to a time of use of the plasma display from a start of use thereof.

A plasma display in a seventeenth embodiment of the invention, according to the plasma display in any of the eleventh to sixteenth embodiments of the invention, is that the sustain discharge emission intensity ratio control section is configured to control the sustain discharge emission intensity ratio by changing the clamp start timing in a position-in-time.

A plasma display in an eighteenth embodiment of the invention, according to the plasma display in any of the eleventh to sixteenth embodiments of the invention, is that the sustain discharge emission intensity ratio control section has an inductance for recovering a charge on a capacitance component of the plasma display panel, and is configured to control the sustain discharge emission intensity ratio by changing the inductance.

A drive method according to an nineteenth embodiment of the invention is for use on a plasma display. The plasma display comprises a plasma display panel; and a driving section for driving the plasma display panel by segmenting one field of display screen into a plurality of sub-fields weighted based on intensity level; the plasma display panel having first and second substrates arranged opposite to each other; a plurality of surface-discharge electrode pairs formed with scan electrodes and sustain electrodes that are arranged parallel one with another with a discharge gap, on an opposed surface of the first substrate to the second substrate; a plurality of data electrodes provided in a form intersecting with the surface-discharge electrode pairs, on an opposed surface of the second substrate to the first substrate; a plurality of unit cells formed at intersections of the plurality of surface-discharge electrode pairs and the plurality of data electrodes; a discharge gas filled between the first substrate and the second substrate, including an interior of the unit cells; a first dielectric layer covering the plurality of surface-discharge electrode pairs; and a second dielectric layer covering the plurality of data electrodes. The driving section sets a scanning time period for applying, line-sequentially for every sub-field, a scan pulse to the scan electrodes and, simultaneously, applying a display date pulse synchronous with the scan pulse to the data electrodes, thereby selecting a unit cell and causing a write discharge in the selected unit cell, and a sustaining time period for applying a sustain pulse alternately to the sustain electrodes and the scan electrodes and causing a sustain discharge within the unit cells. The method is characterized by: setting, for every pulse, a charge-recovering time period for recovering a charge on a capacitance component of the plasma display panel and a clamp timing period for applying a predetermined sustain voltage to the sustain electrodes or the scan electrodes after the charge-recovering time period through clamp start timing, and to set a sustain discharge emission intensity ratio, as a ratio of a maximal discharge intensity in the clamp timing period with reference to a discharge intensity in the clamp start timing to a maximum discharge intensity in the charge-recovering time period, at a value that a discharge in the clamp timing period is to spread up to an end of the unit cell.

A drive method according to a twentieth embodiment of the invention is for use on a plasma display. The plasma display comprises: a plasma display panel; and a driving section for driving the plasma display panel by segmenting one field of display screen into a plurality of sub-fields weighted based on intensity level; the plasma display panel having first and second substrates arranged opposite to each other; a plurality of surface-discharge electrode pairs formed with scan electrodes and sustain electrodes that are arranged parallel one with another with a discharge gap, on an opposed surface of the first substrate to the second substrate; a plurality of data electrodes provided in a form intersecting with the surface-discharge electrode pairs, on an opposed surface of the second substrate to the first substrate; a plurality of unit cells formed at intersections of the plurality of surface-discharge electrode pairs and the plurality of data electrodes; a discharge gas filled between the first substrate and the second substrate, including an interior of the unit cells; a first dielectric layer covering the plurality of surface-discharge electrode pairs; and a second dielectric layer covering the plurality of data electrodes. The driving section sets a scanning time period for applying, line-sequentially for every sub-field, a scan pulse to the scan electrodes and, simultaneously, a display data pulse synchronous with the scan pulse to the data electrodes, thereby selecting a unit cell and causing a write discharge in the selected unit cell and a sustaining time period for applying a sustain pulse alternately to the sustain electrodes and the scan electrodes and causing a sustain discharge within the unit cells. The method is characterized by: setting, for every pulse, a charge-recovering time period for recovering a charge on a capacitance component of the plasma display panel and a clamp timing period for applying a predetermined sustain voltage to the sustain electrodes or the scan electrodes after the charge-recovering time period through clamp start timing, and to set a sustain discharge emission crest value ratio, as a ratio of a crest value of a discharge emission waveform in the clamp timing period to a crest value of a discharge emission waveform in the charge-recovering time period, smaller than 1.

According to the structure of the invention, sustain display emission intensity ratio control means is provided to set up, for every sustain pulse, a charge-recovering time period for recovering the charge on the capacitance component of the plasma display panel and a clamp timing period for applying a predetermined voltage to the sustain electrodes and scan electrodes after the charge-recovering time period through clamp start timing. Furthermore, it sets a sustain discharge emission intensity ratio, as a ratio of the maximum discharge intensity in the clamp timing period with reference to the discharge intensity in the clamp start timing to the maximum discharge intensity in the charge-recovering time period, at a value that discharge in the clamp period is to spread to an end of the unit cell. Accordingly, this can suppress display non-uniformity and image retention. For example, by setting the sustain discharge emission intensity ratio at approximately 0.5 or greater or approximately 0.1 or smaller by means of the sustain discharge emission ratio control means, image retention intensity ratio becomes 1 thus suppressing the occurrence of image retention.

Meanwhile, sustain discharge emission crest value ratio control means is provided to set up, for every sustain pulse, a charge-recovering time period for recovering the charge on the capacitance component of the plasma display panel and a clamp timing period for applying a predetermined voltage to the sustain electrodes and scan electrodes after the charge-recovering time period through clamp start timing.

Furthermore, it sets a sustain discharge emission crest value ratio, as a ratio of a crest value of discharge emission waveform in the clamp timing period to a crest value of discharge emission waveform in the charge-recovering time period, at a value that discharge in the clamp period is to spread to an end of the unit cell. Accordingly, this can suppress display non-uniformity and image retention.

The clamp start timing in a position-in-time and the inductance value on the charge recovering circuit are regulated by means of a display pattern, ambient environmental temperature, time of use or the like, to provide a sustain discharge of after clamp start timing with an emission intensity of approximately 0.5 times or greater or approximately 0.1 times or smaller than the discharge intensity of before clamp start timing, or otherwise, to provide a discharge emission waveform of after clamp start timing with a crest value smaller than the crest value of a discharge emission waveform of before clamp start timing. Due to this, a plasma display is provided that display non-uniformity and image retention can be suppressed.

DETAILED DESCRIPTION OF THE INVENTION

Figure 1:
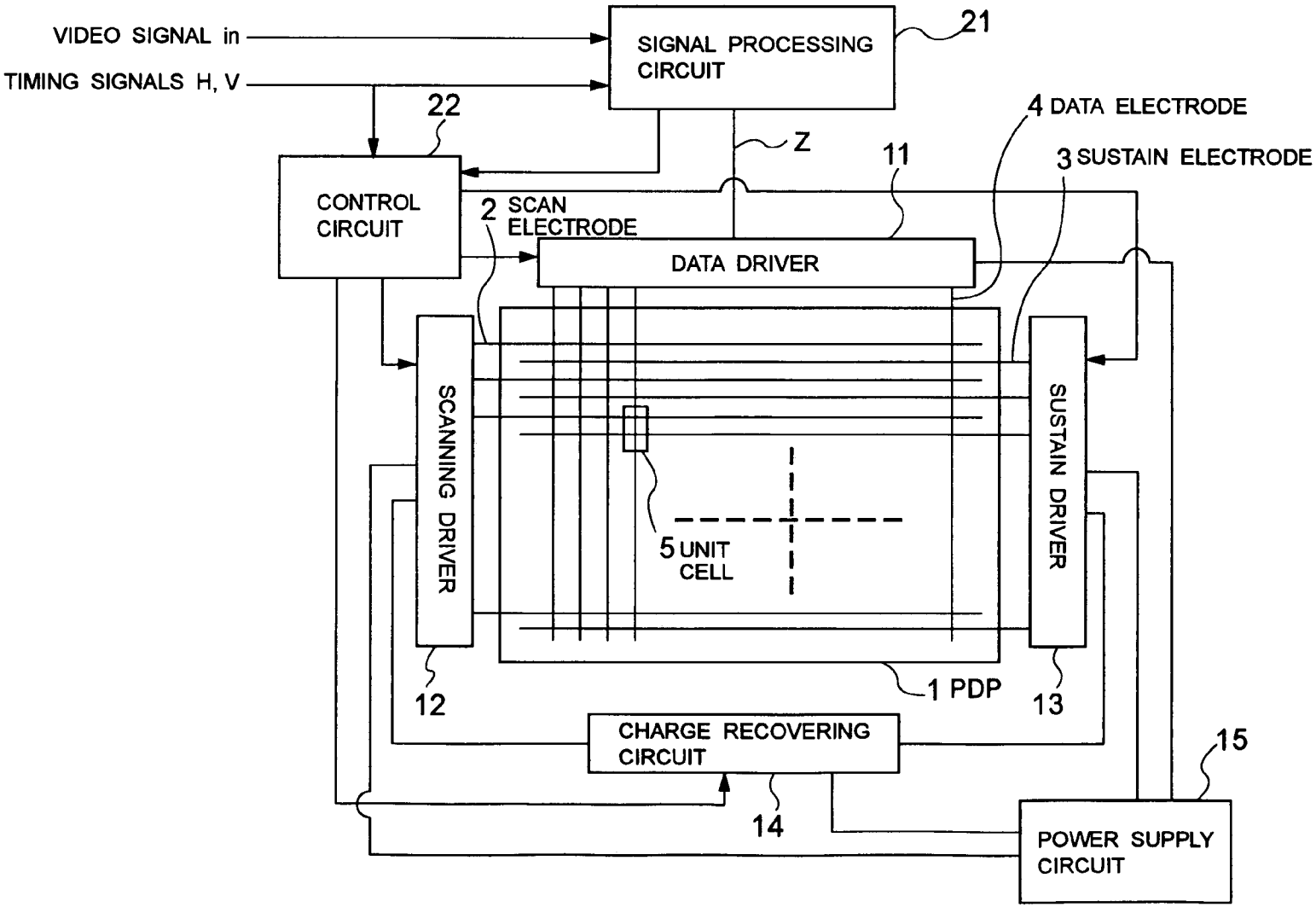
FIG. 1 is an arrangement diagram of a plasma display in the prior art.
Figure 10:
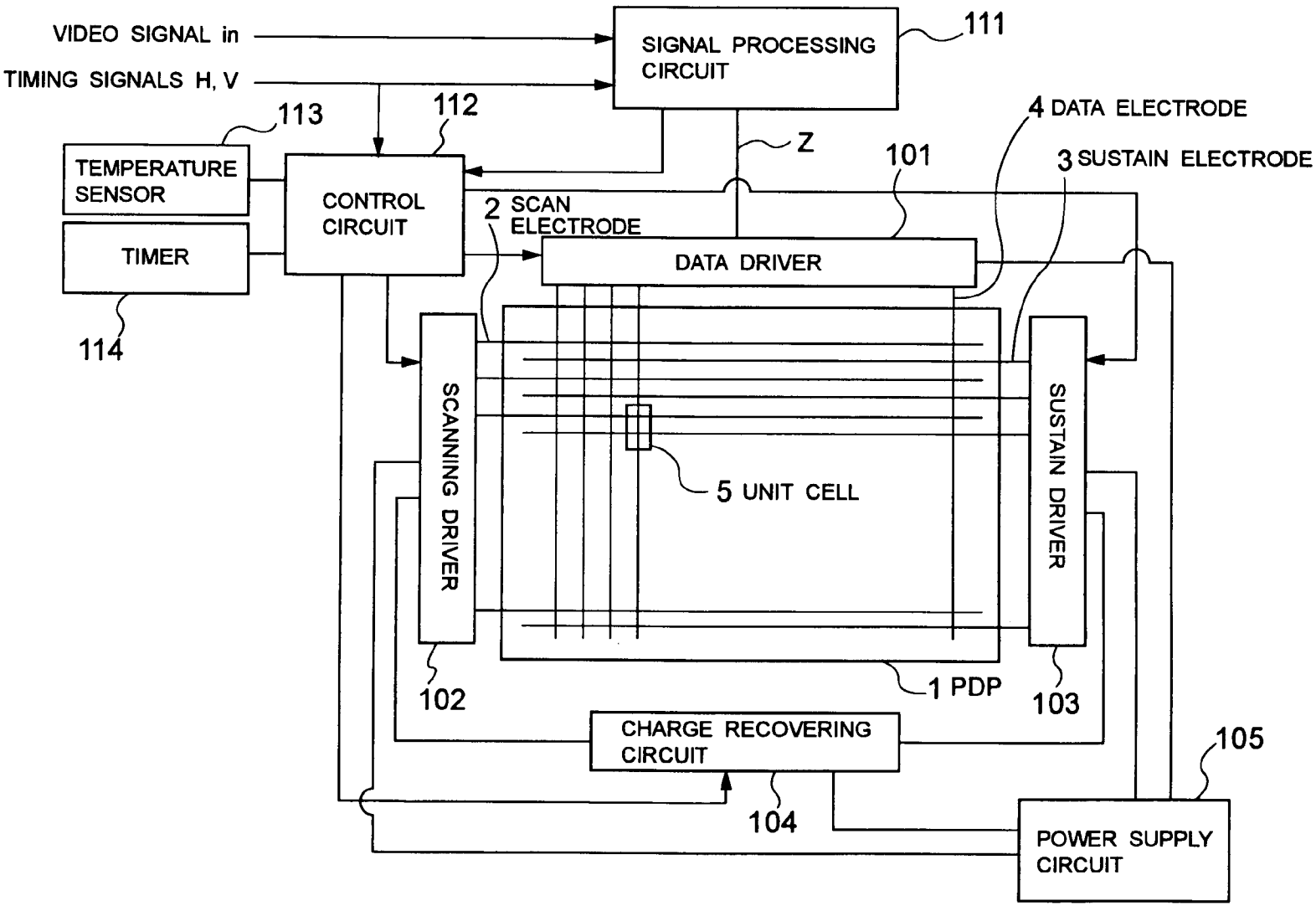
FIG. 10 is a block diagram showing an electric arrangement of a plasma display in a first embodiment of the invention.

FIG. 10 is a block diagram showing an electric arrangement of a plasma display in a first embodiment of this invention, wherein the common references are attached to the elements common to the elements in the FIG. 1 prior art.

Figure 2:
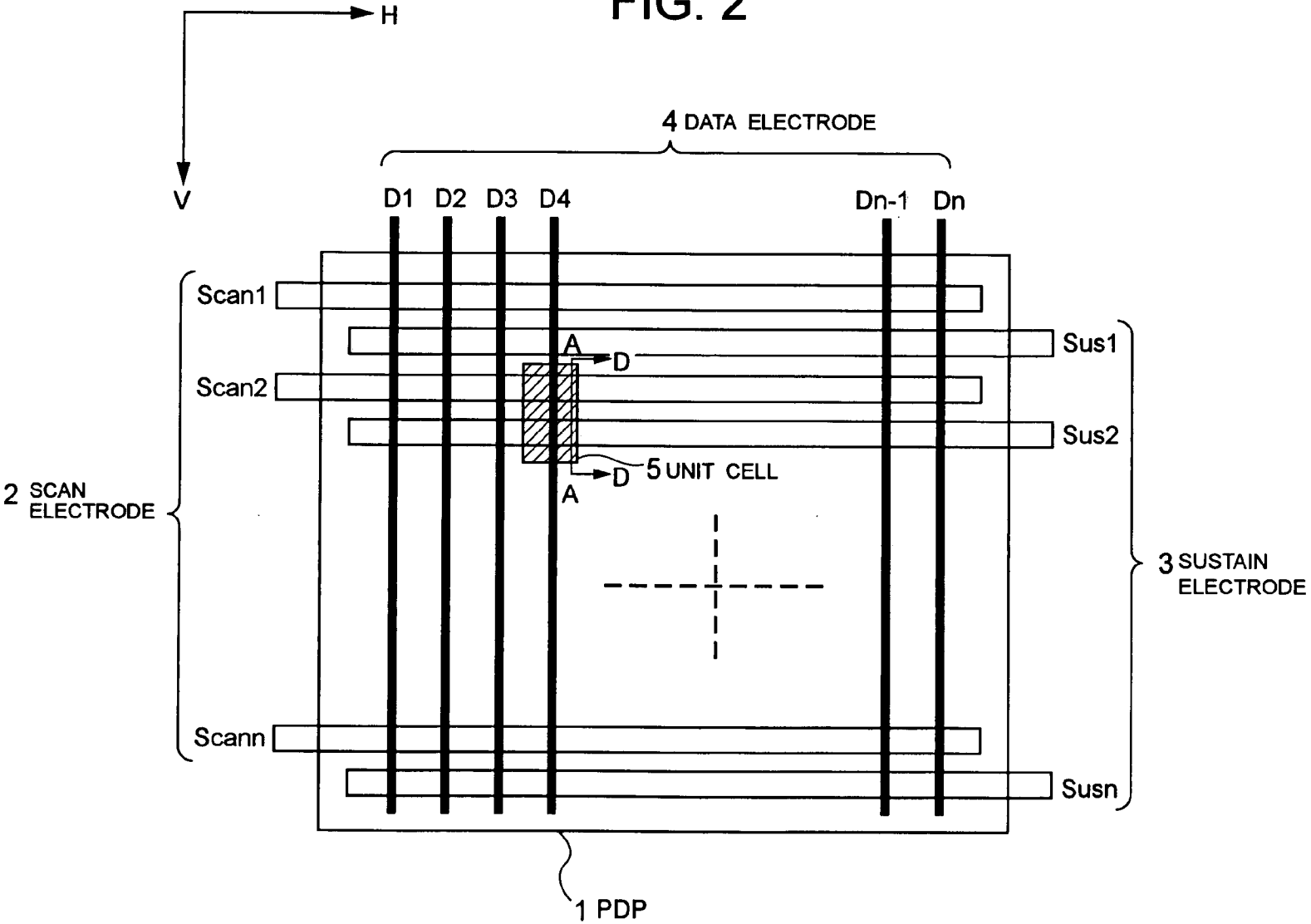
FIG. 2 is a structural view showing an essential part of a PDP 1 in FIG. 1.
Figure 3:
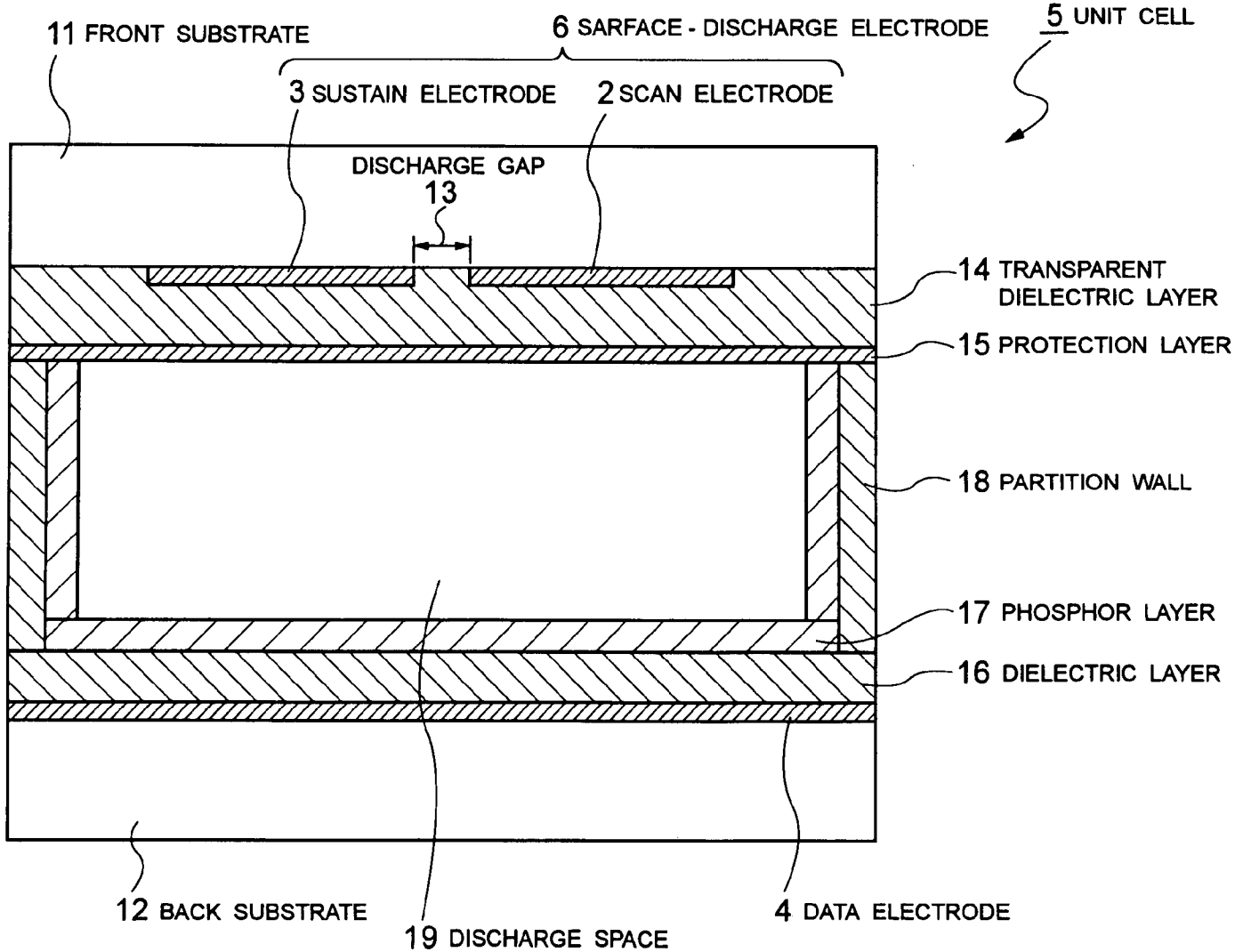
FIG. 3 is a cross-sectional view of a unit cell 5 taken on line A-A in FIG. 2.
Figure 4:
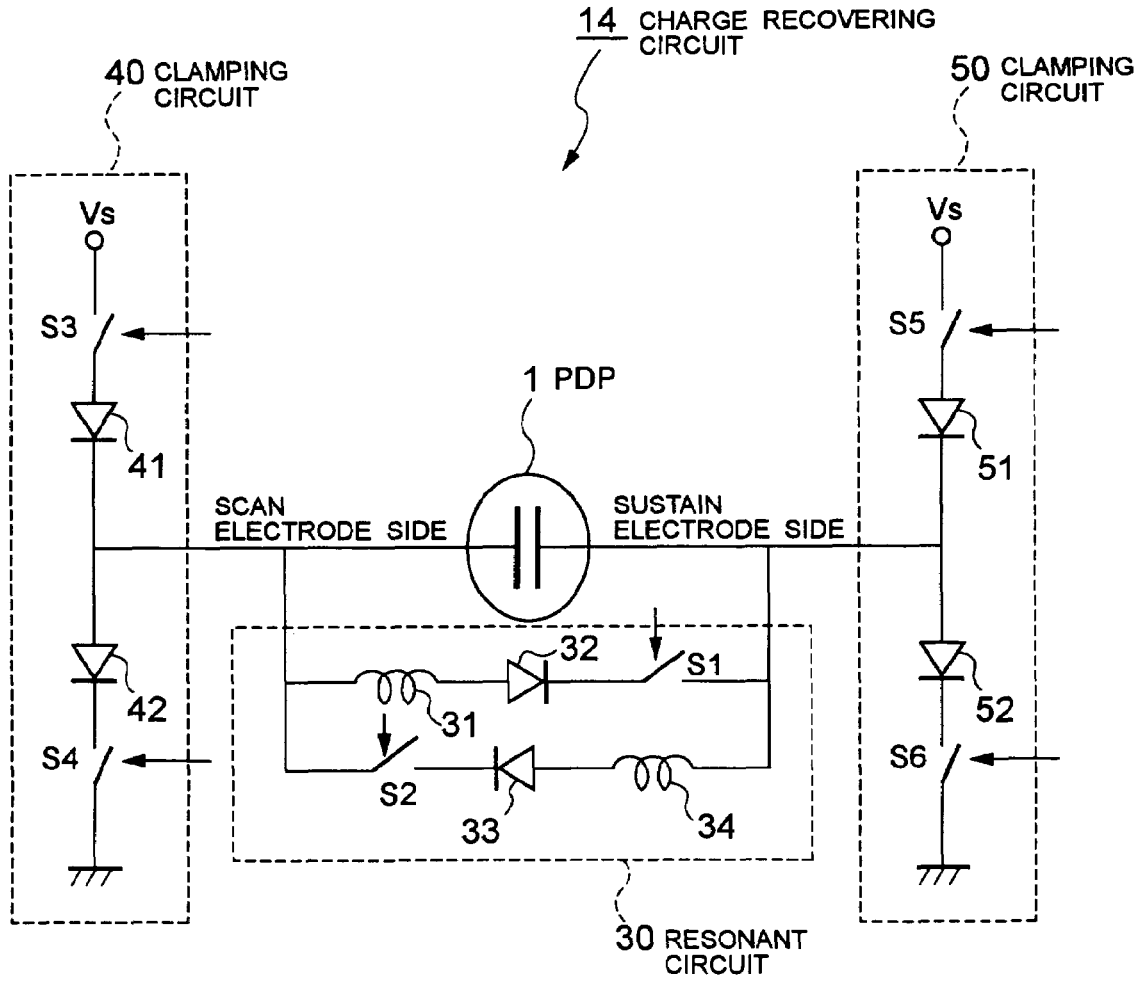
FIG. 4 is a circuit diagram showing an electric configuration of the PDP 1 and charge recovering circuit 14 in FIG. 1.
Figure 5:
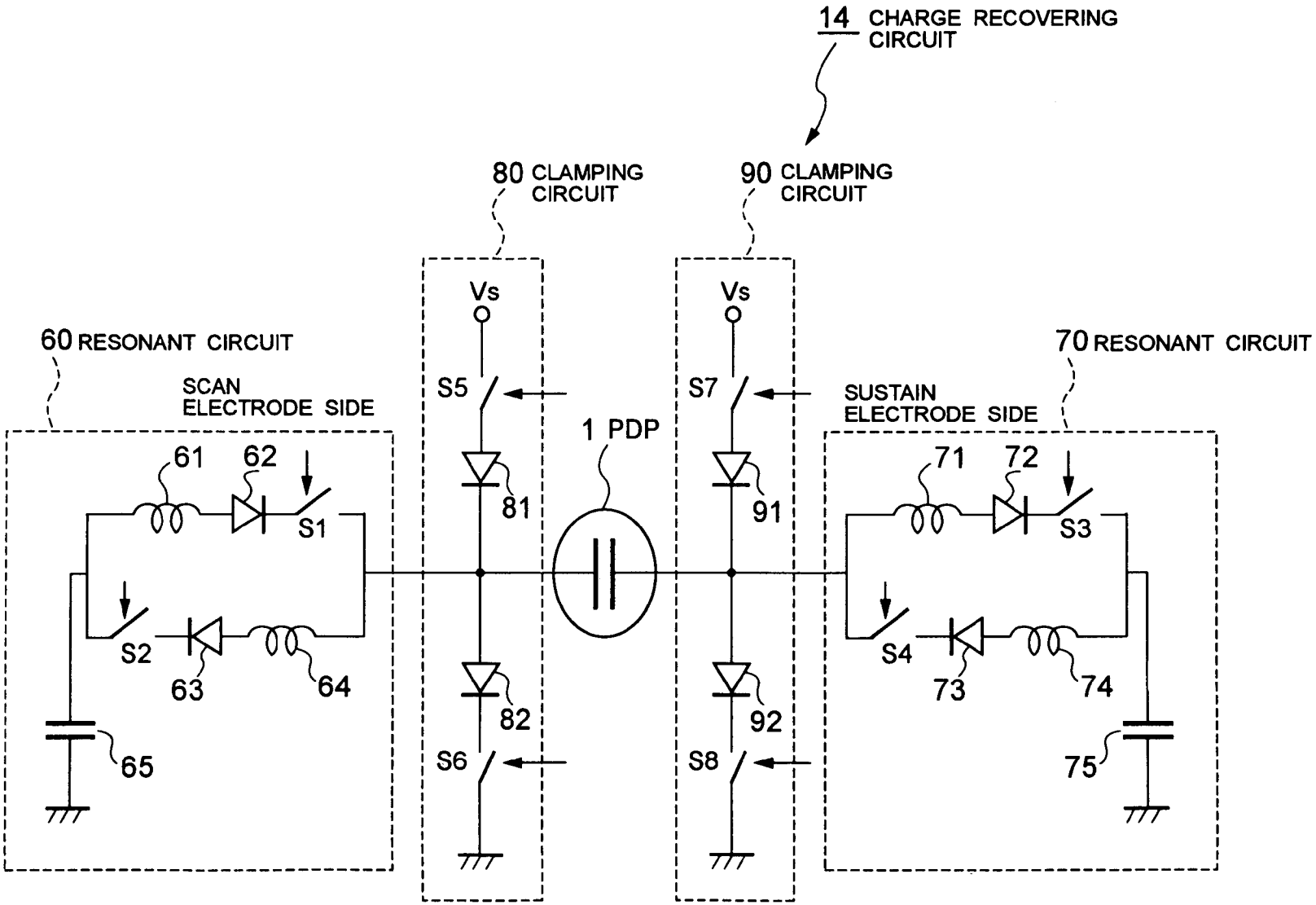
FIG. 5 is a circuit diagram showing another electric configuration of the charge recovering circuit 14 in FIG. 1.

The plasma display in this embodiment is arranged with a display panel (PDP) 1, a data driver 101, a scanning driver 102, a sustain driver 103, a charge recovering circuit 104, a power supply circuit 105, a signal processing circuit 111, a control circuit 112, a temperature sensor 113 and a timer 114. The PDP 1 is structured similarly to the FIG. 2 prior art. The data driver 101 is to apply a data pulse and erase pulse corresponding to display data z, to the data electrode 4 of the PDP 1. The scanning driver 102 is to apply a scan pulse and erase pulse to the scan electrode 2 of the PDP 1. The sustain driver 103 is to apply a sustain pulse to the sustain electrode 3 of the PDP 1. The charge recovering circuit 104, having an inductance for recovering the charge on the capacitance component of the PDP 1, is to set up a potential at the scan electrode 2 and sustain electrode 3 of the PDP 1 under control of the control circuit 112.

The power supply circuit 105 is to supply a predetermined high-voltage power to the data driver 101, the scanning driver 102, the sustain driver 103 and the charge recovering circuit 104. The signal processing circuit 111, is configured with an A/D conversion circuit, a pixel conversion circuit and a sub-field conversion circuit and so on, which are not shown. In the A/D conversion circuit, an analog video signal "in" is converted into a digital video signal. In the pixel conversion circuit, the number of pixels in the video signal is converted into the number of pixels corresponding to the PDP 1 thus generating a video signal. The sub-field conversion circuit converts the video signal of from the pixel conversion circuit into sub-field-based display data-z and forwards it to the data driver 101. The temperature sensor 113 is to detect an ambient environmental temperature of the plasma display. The timer 114 is to count a time of use of from start of using the plasma display (hereinafter, referred to as "use time").

The control circuit 112 is to control the operation timing of the data driver 101, the scanning driver 102, the sustain driver 103 and the charge recovering circuit 104, thereby controlling the input of a voltage generated by the power supply circuit 105. Particularly, in this embodiment, the control circuit 112 sets, for every sustain pulse, in the charge recovering circuit 104 a charge-recovering time period for recovering the charge on the capacitance of the PDP 1 and a clamp timing period for applying a predetermined sustain voltage to the sustain electrodes 3 or the scan electrodes 2 after the charge-recovering time period through clamp start timing. Furthermore, a sustain discharge emission intensity ratio, as a ratio of the maximum discharge intensity in the clamp timing period with reference to a discharge intensity in the clamp start timing to the maximum discharge intensity in the charge-recovering time period, is set at a value allowing a discharge in the clamp period to spread up to an end of the unit cell 5.

For example, the control circuit 112 sets the sustain discharge emission intensity ratio at approximately 0.5 or greater or at approximately 0.1 or smaller. In this case, the control circuit 112 controls a sustain discharge emission intensity ratio according to the image retention intensity ratio as a ratio of a luminance at a point where the luminance changed by an image retention to a luminance at a point where there is no image retention of display pattern of the PDP 1, the load of display over sub-fields, the change in the discharge initiating threshold voltage within the unit cell 5, the ambient environmental temperature detected by the temperature sensor 113 or the time of use measured by the timer 114.

Meanwhile, when the load of display over sub-fields is 100%, the control circuit 112 sets a sustain discharge emission intensity ratio at approximately 0.5 or greater or at approximately 0.1 or smaller. The control circuit 112 controls the sustain discharge emission intensity ratio by changing the charge-recovering time period and clamp timing period in its time width. Meanwhile, the control circuit 112 controls the sustain discharge emission intensity ratio by changing the inductance of the charge recovering circuit 104. Timing signals (horizontal and vertical synchronizing signals) H, V are to be inputted to the signal processing circuit 111 and control circuit 112, to take synchronism of the operation thereof with on-screen display.

Figure 11:
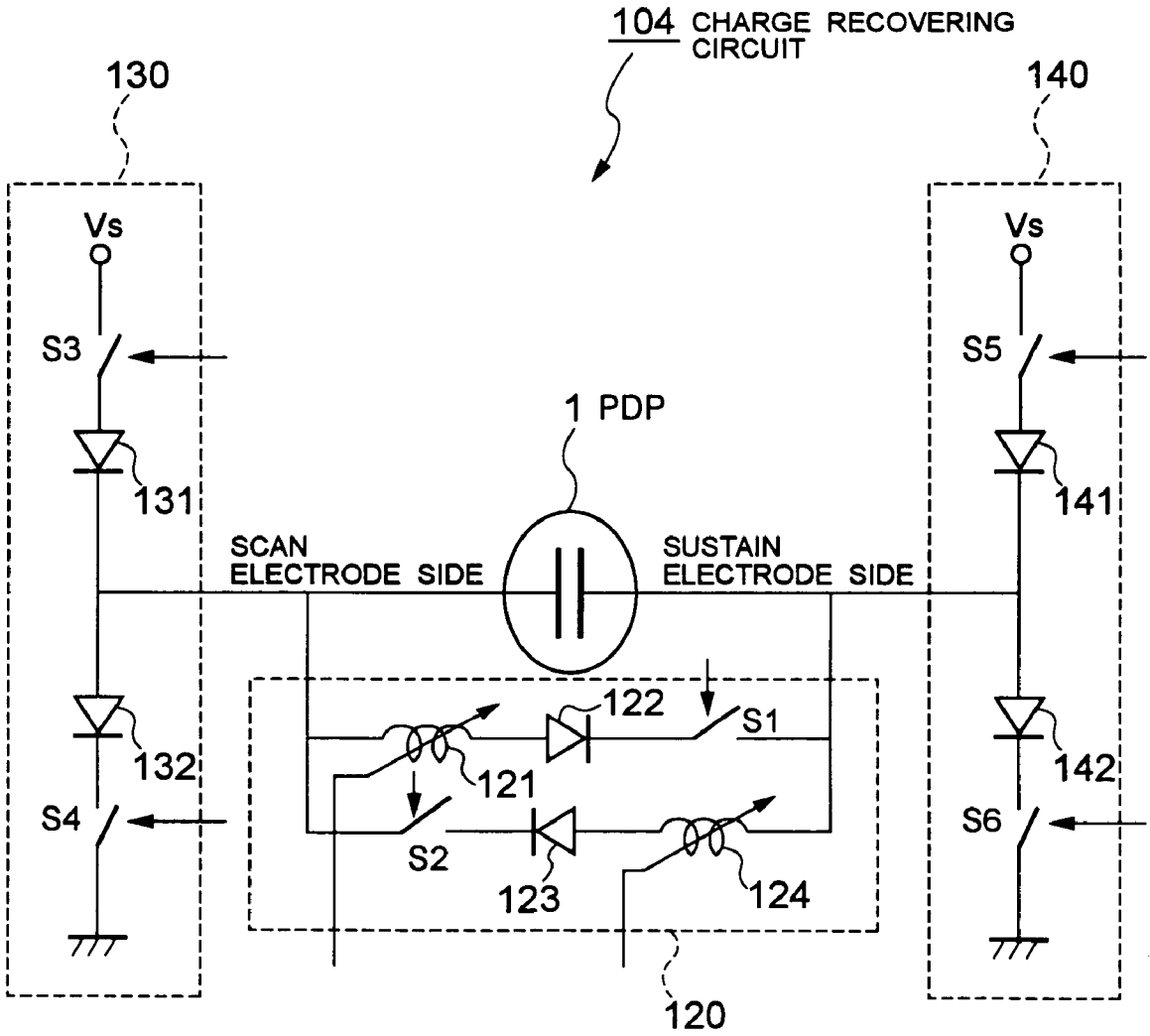
FIG. 11 is a circuit diagram showing an electric arrangement in which the PDP 1 and the charge recovering circuit 104 are extracted out of FIG. 10.

FIG. 11 is a circuit diagram showing an electric arrangement extracting the PDP 1 and the charge recovering circuit 104 out of FIG. 10.

The charge recovering circuit 104 is configured with a resonant circuit 120 and clamp circuits 130, 140, as shown in FIG. 11. The resonant circuit 120 is configured with an inductance 121, a diode 122, switches S1, S2, a diode 123 and an inductance 124. In the resonant circuit 120, the control circuit 112 controls the on-off state of the switches S1, S2, to control the inductances 121, 124. When the inductance 121 or 124 and the PDP 1 capacitance component go into a resonant state, the charge on the capacitance component of the PDP 1 is restored by the inductance 121 or 124.

The clamping circuit 130 is configured with switches S3, S4 and diodes 131, 132. In the clamping circuit 130, the control circuit 112 controls the on-off state of the switch S3, S4 and sets the scan electrode 2 of the PDP 1 at a voltage Vs or a ground level. The clamping circuit 140 is configured with switches S5, S6 and diodes 141, 142. In the clamping circuit 140, the control circuit 112 controls the on-off state of the switch S5, S6 and sets the sustain electrode 3 of the PDP 1 at a voltage Vs or a ground level.

Figure 12A:
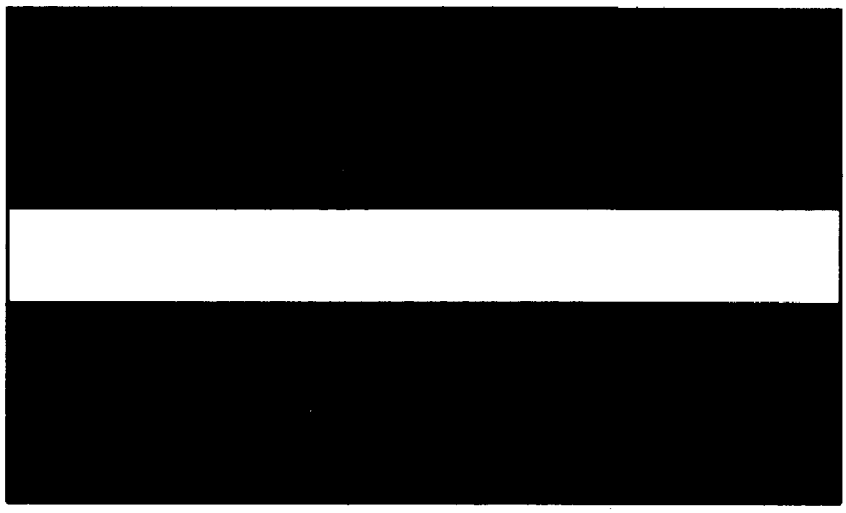
FIGS. 12A and 12B are figures showing a display pattern for evaluating image retention.
Figure 12B:
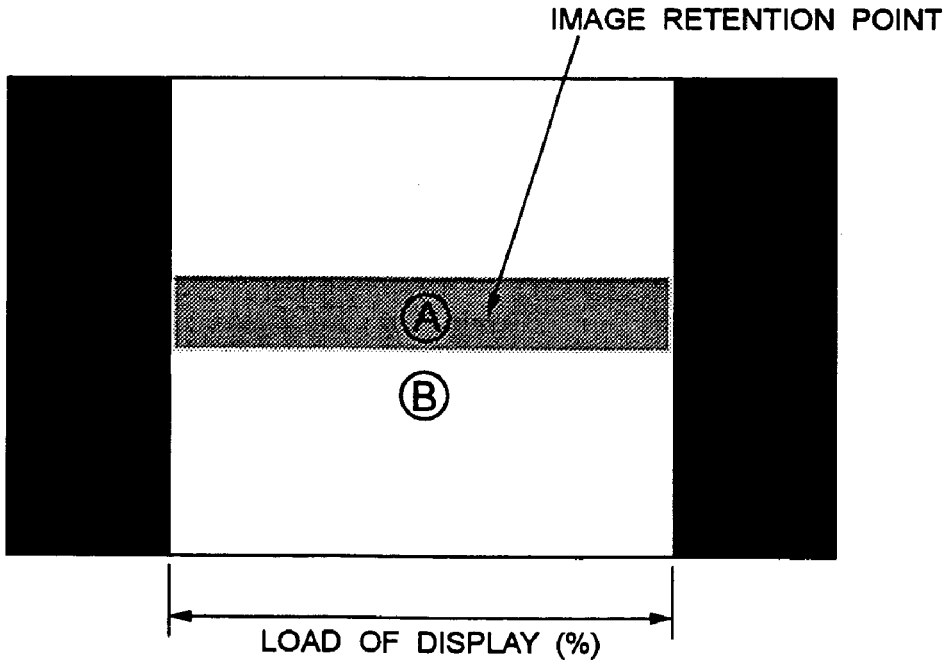
Figure 13:
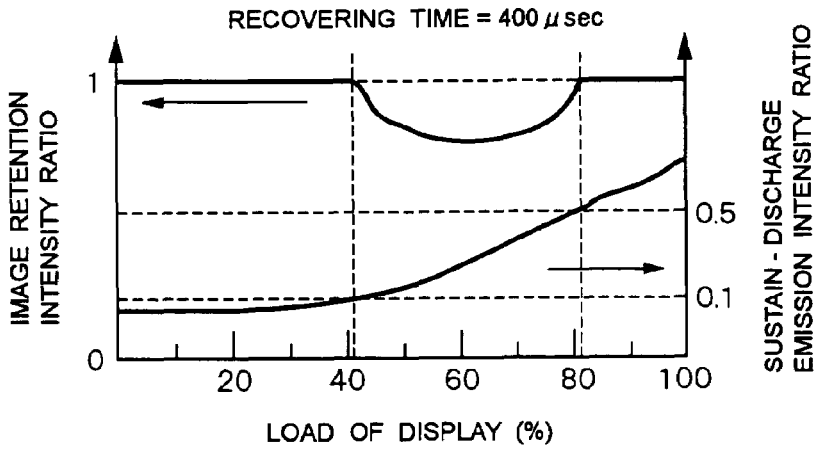
FIG. 13 is a figure showing a relationship between a load of display and a sustain discharge intensity ratio and image retention intensity ratio.
Figure 14:
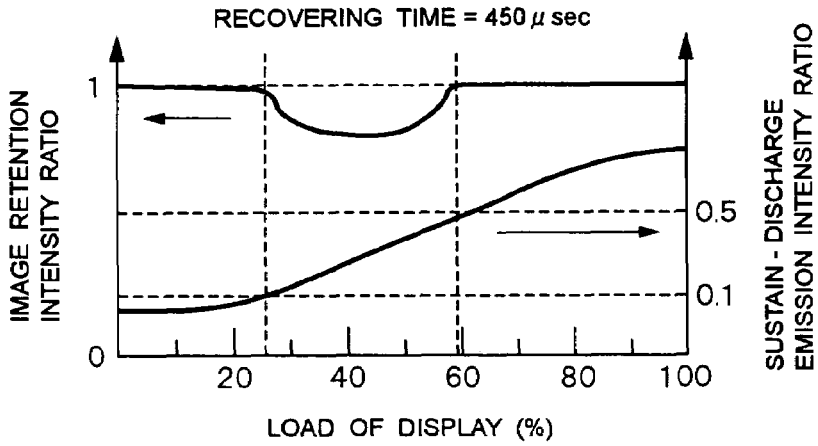
FIG. 14 is a figure showing a relationship between a load of display and a sustain discharge intensity ratio and image retention intensity ratio.
Figure 15:
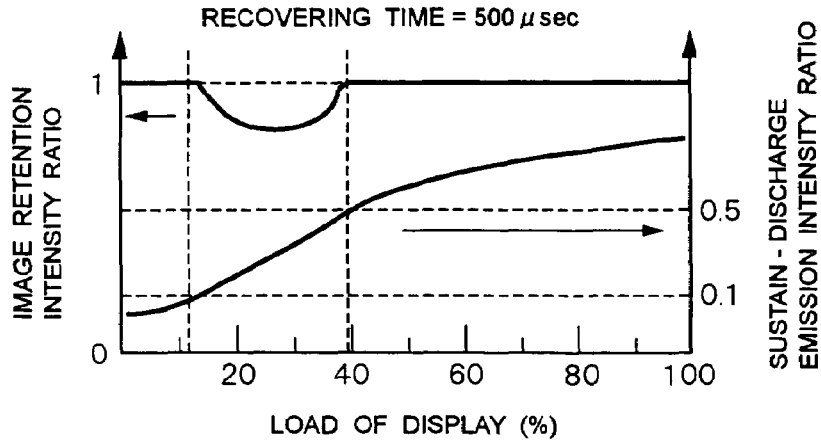
FIG. 15 is a figure showing a relationship between a load of display and a sustain discharge intensity ratio and image retention intensity ratio.
Figure 16A:
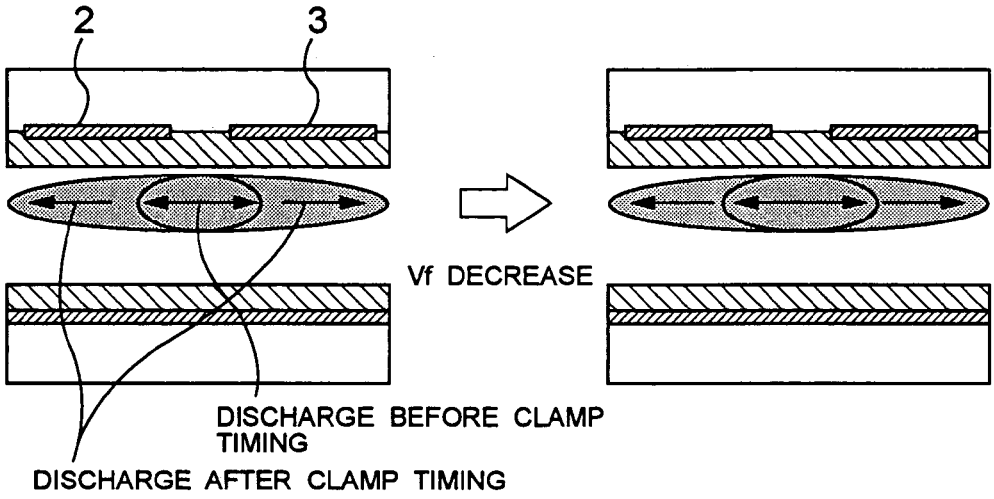
FIGS. 16A-16C are typical views explaining the spread of a sustain discharge before clamp start timing and a sustain discharge after clamp start timing.
Figure 16B:
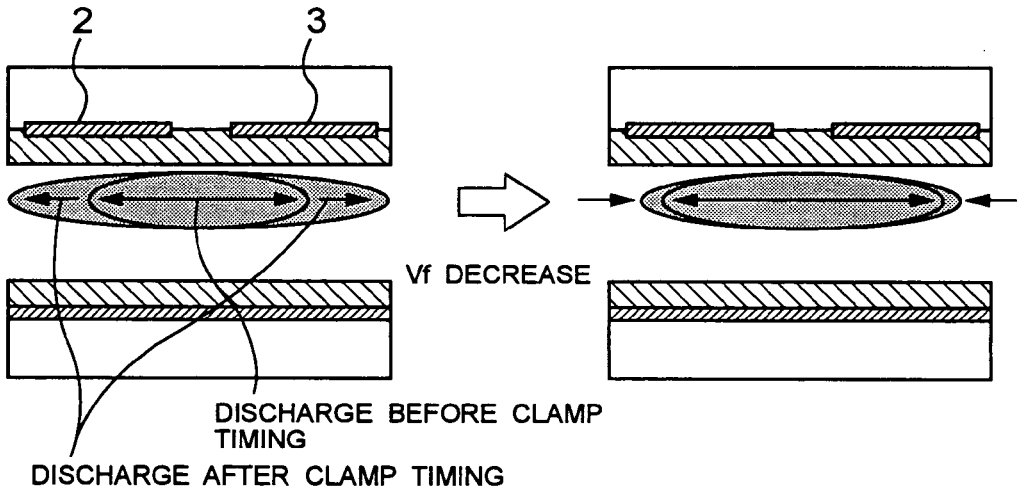
Figure 16C:
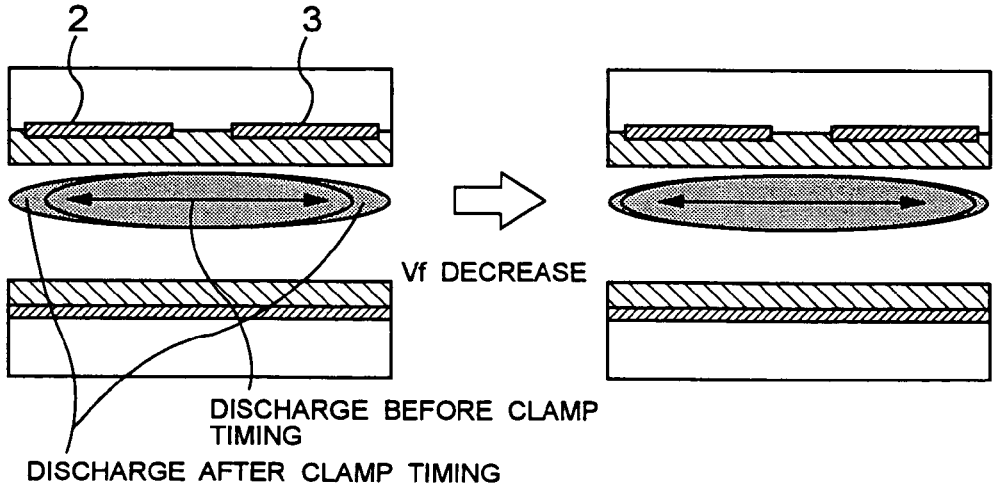
Figure 17:
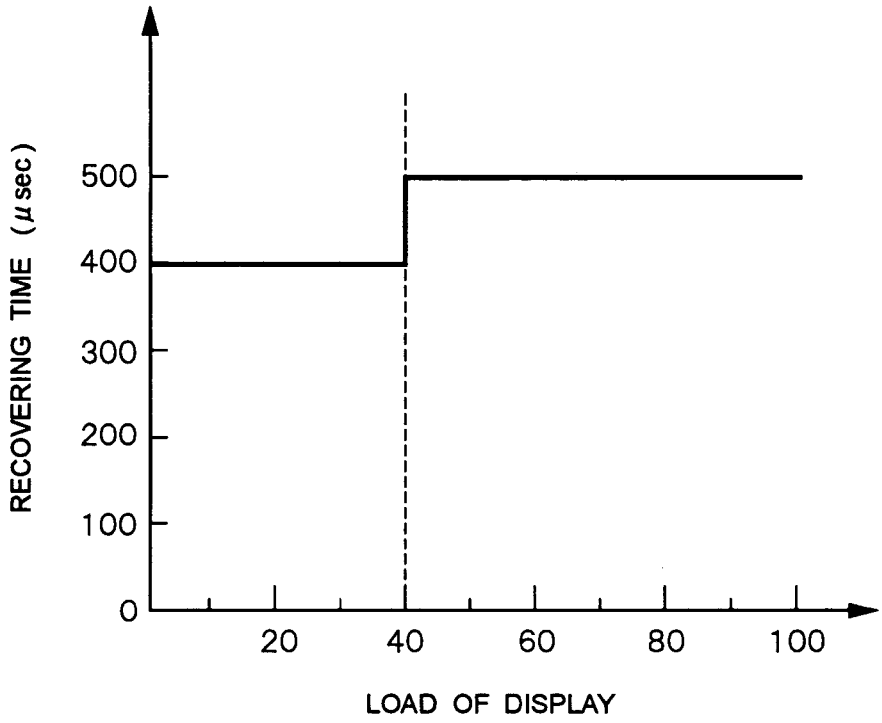
FIG. 17 is a figure showing a relationship between a load of display and a recovering time.
Figure 18:
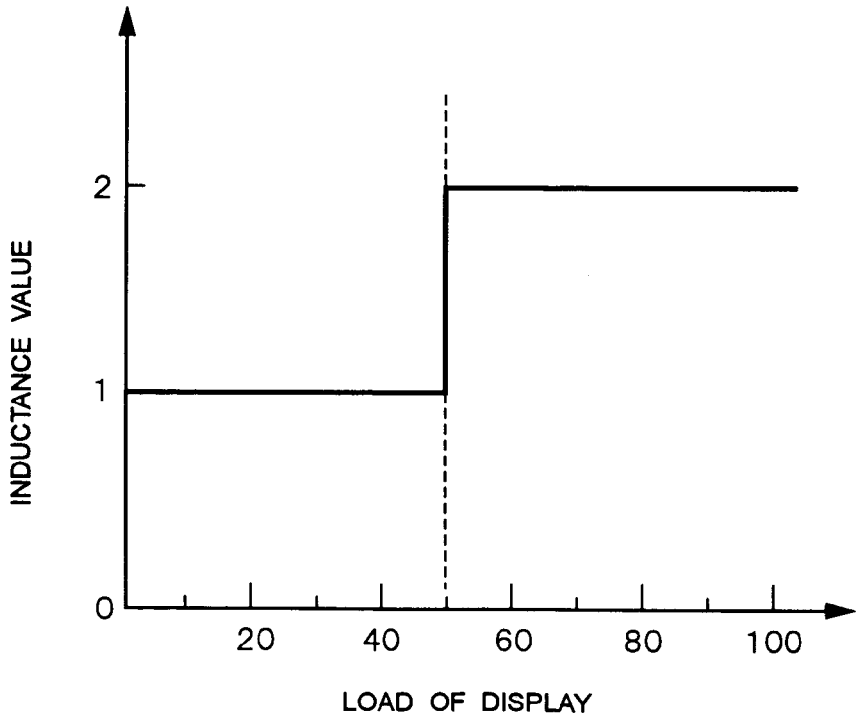
FIG. 18 is a figure showing a relationship between a load of display and an inductance value.
Figure 19:
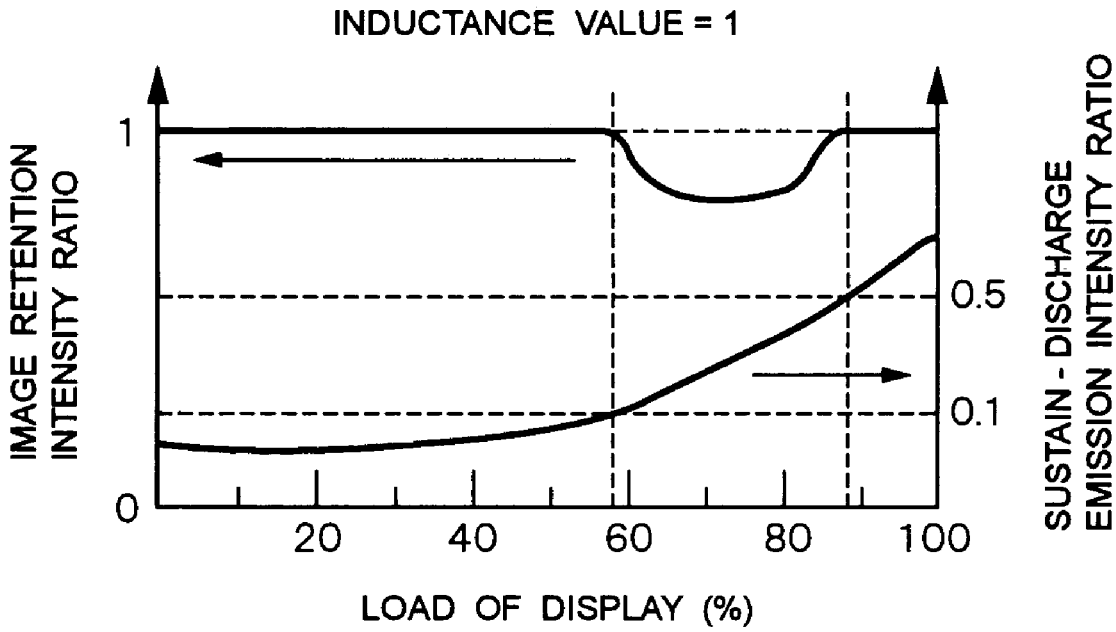
FIG. 19 is a figure showing a relationship between a load of display and a sustain discharge emission intensity ratio and image retention intensity ratio, at each inductance value.
Figure 20:
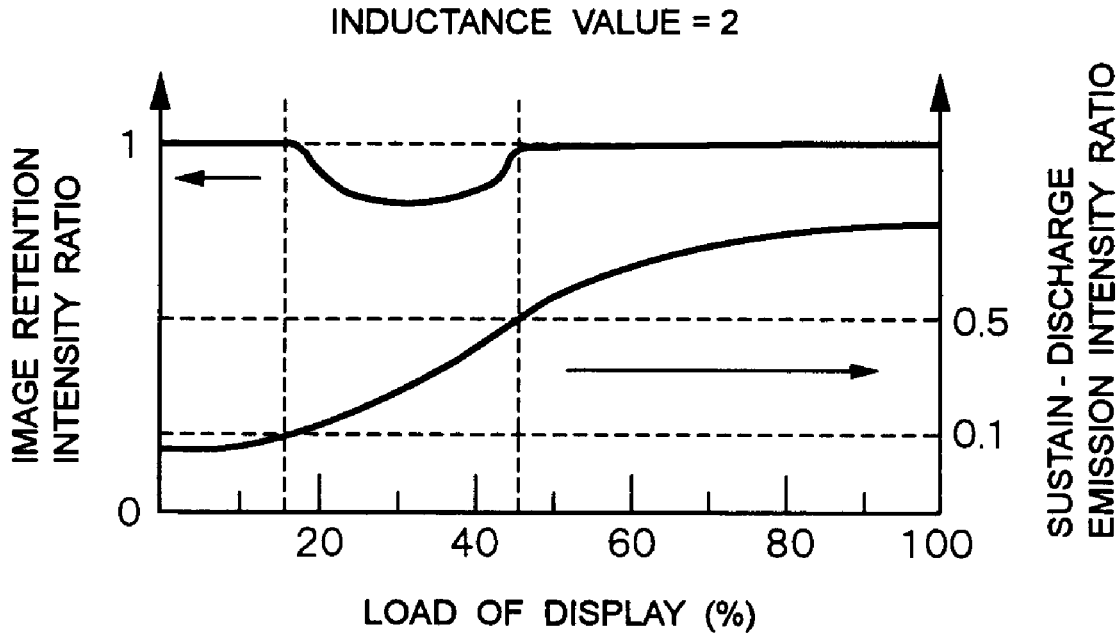
FIG. 20 is a figure showing a relationship between a load of display and a sustain discharge emission intensity ratio and image retention intensity ratio, at each inductance value.

FIGS. 12A and 12B are figures showing display patterns for evaluating the image retention. FIGS. 13 to 15 are figures showing a relationship between a load of display and a sustain discharge intensity ratio and image retention luminance ratio. FIGS. 16A to 16C are typical views explaining the spread of a sustain discharge before clamp start timing and the spread of a sustain discharge after clamp start timing. FIG. 17 is a figure showing a relationship between a load of display and a recovering time. FIG. 18 is a figure showing a relationship between a load of display and an inductance value. FIGS. 19 and 20 are figures showing, at each inductance value, a relationship between a load of display and a sustain discharge intensity ratio and image retention luminance ratio. FIGS. 21 to 24 are figures showing a relationship between a load of display and a recovering time.

Referring to those figures, explanation is made as to the processing for a drive method for use on the plasma display in this embodiment.

In the plasma display, for every sustain pulse, a charge-recovering time period for recovering the charge on the capacitance component of the PDP 1 and a clamp timing period for applying a predetermined sustain voltage to the sustain electrodes 3 and scan electrodes 2 after the charge restore time period through a clamp start timing are set. The sustain discharge emission intensity ratio, a ratio of the maximum discharge intensity in the clamp period with reference to the discharge intensity in the clamp start timing to the maximum discharge intensity in the discharge restore time period, is set at a value allowing a discharge in the clamp timing period to spread up to an end of the unit cell 5.

Figure 7:
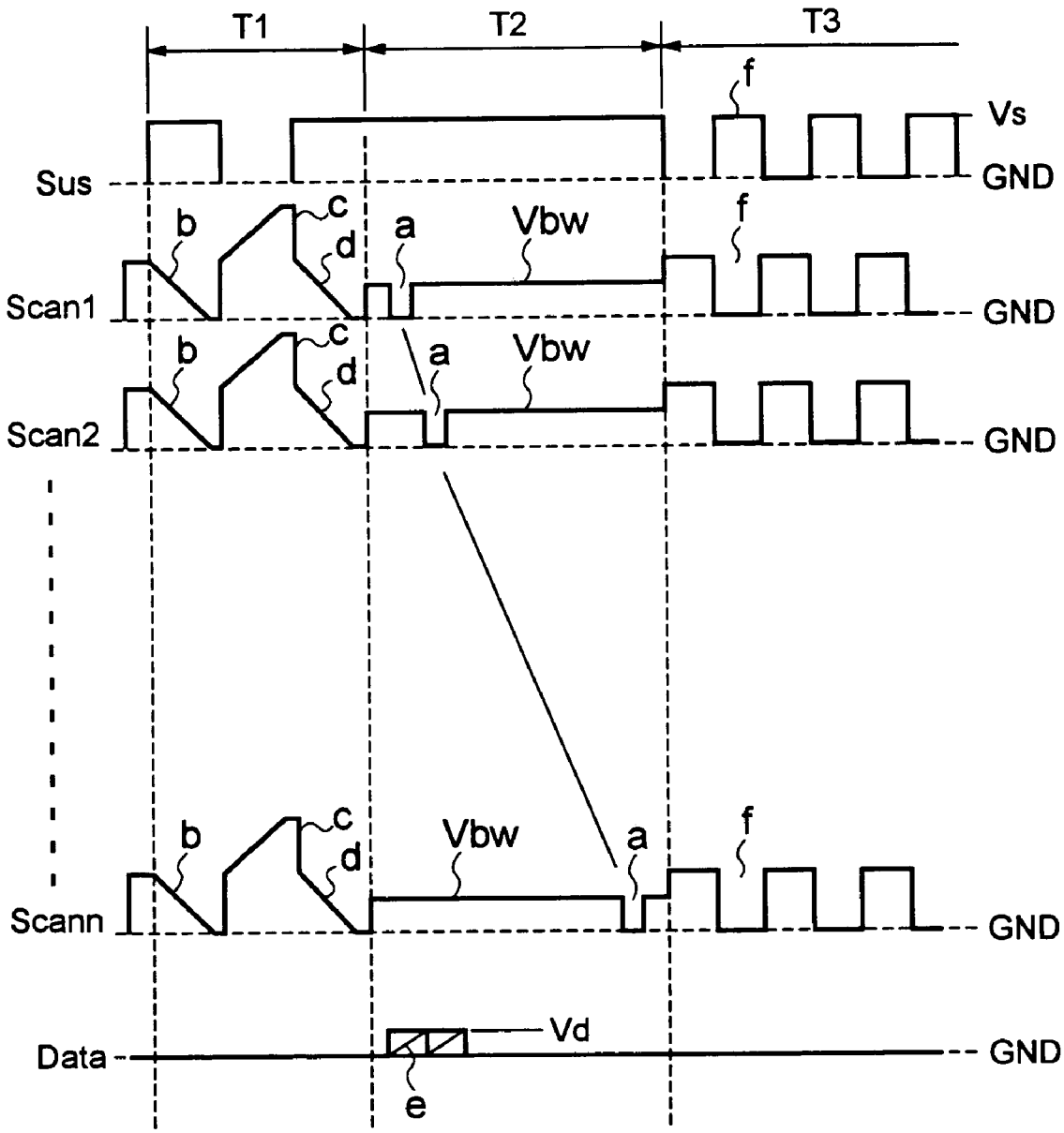
FIG. 7 is a figure showing an essential part of a drive waveform for use on the Address Display Separate method.
Figure 8:
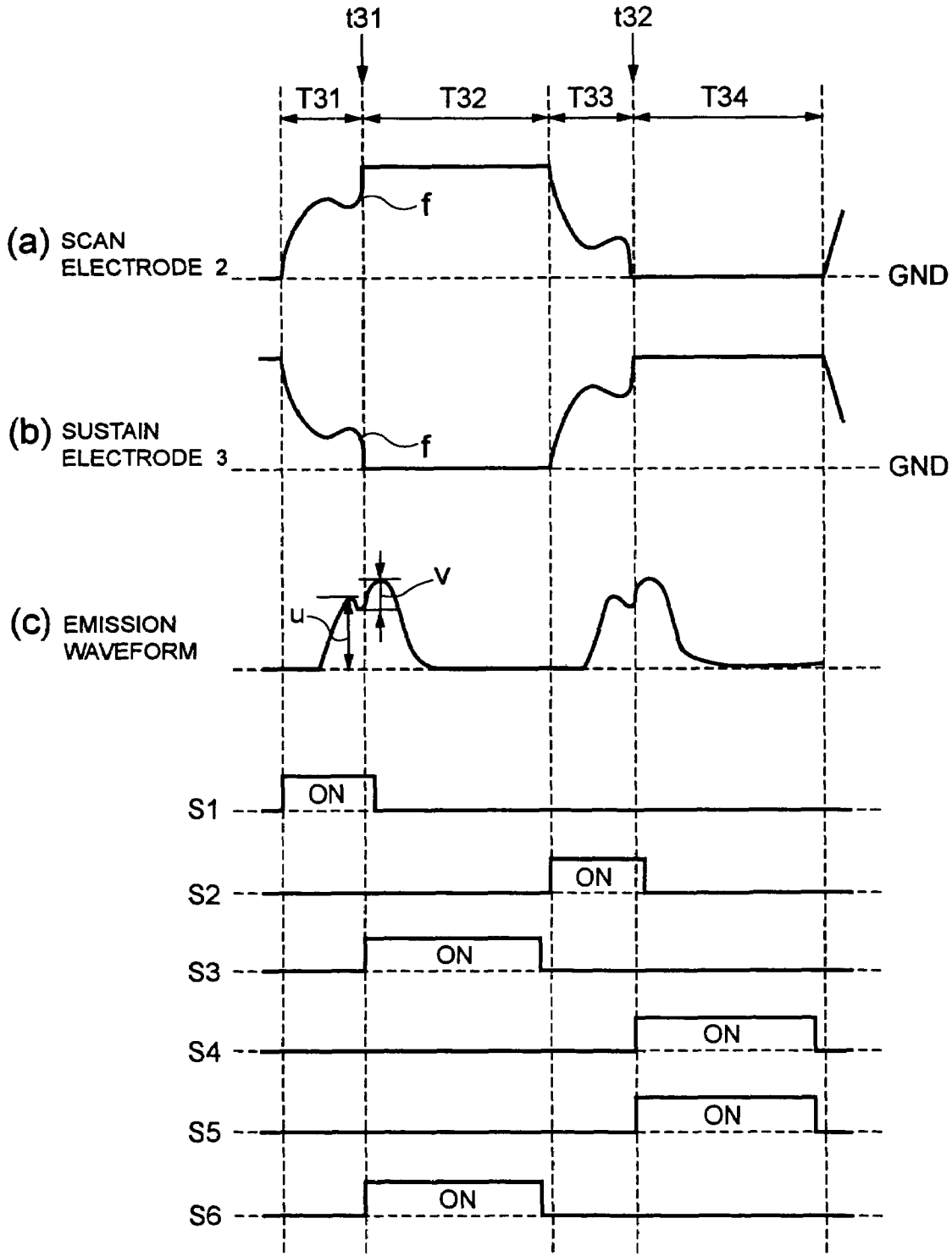
FIG. 8 is a time chart explaining the operation at various points in the sustaining time period T3 in FIG. 7 where the FIG. 1 charge recovering circuit is provided in a structure shown in FIG. 4.
Figure 9:
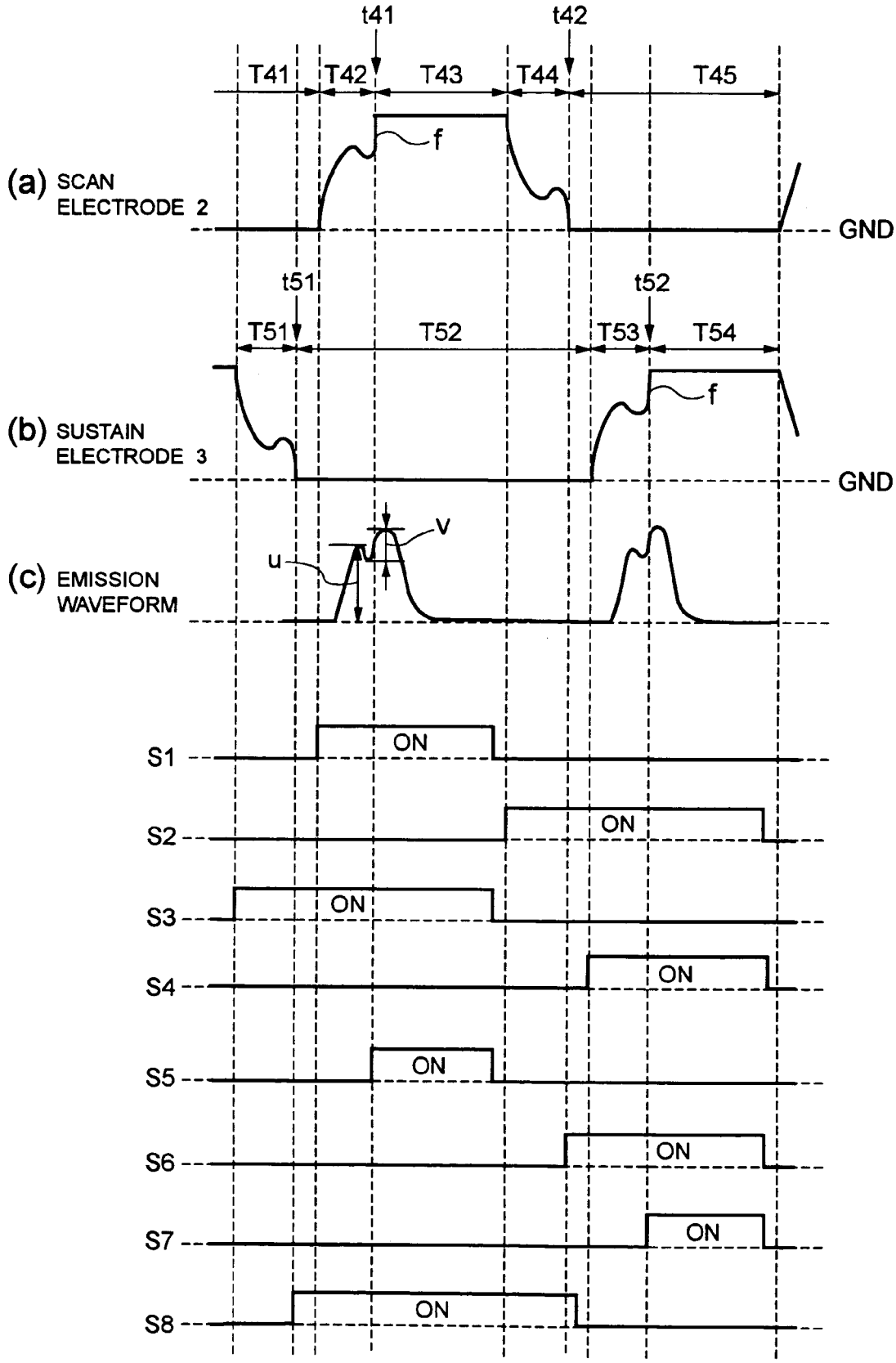
FIG. 9 is a time chart explaining the operation at various points in the sustaining time period T3 in FIG. 7 where the FIG. 1 charge recovering circuit is provided in a structure shown in FIG. 5.

The sustain discharge emission intensity ratio is a ratio (=v/u) of a sustain discharge intensity v of after clamp start timing to a sustain discharge intensity u of before clamp start timing (t31 in FIG. 8, t41 in FIG. 9), on an emission waveform due to sustain discharge shown in (c) in FIG. 8 or (c) in FIG. 9. The sustain discharge intensity v of after clamp start timing serves as an intensity difference of from the maximum intensity of after clamp start timing, with reference to the discharge intensity in clamp start timing, as shown in FIG. 7 or 8. In (c) in FIG. 8 or (c) in FIG. 9, the sustain discharge intensity v once takes the maximum value before the timing of clamp start, wherein the intensity is somewhat weak before the clamp start timing. However, at a certain clamp start timing point or at a certain discharge initiating threshold voltage within unit cell 5, there are cases that the intensity less weakens before the clamp start timing thus causing discharge continuously as it is. In such a case, discharge intensity is also defined as in the foregoing.

Image retention refers to a phenomenon that even when, after displaying a certain display pattern, a different display pattern is displayed, the former display pattern remains existing. Meanwhile, the image retention intensity ratio is a ratio of a luminance at a point where luminance changed by an image retention, to a luminance at a point free of image retention. The image retention intensity ratio of 1 represents no occurrence of image retention. The image retention intensity ratio, when smaller than 1, represents that luminance is lower at an image retention occurrence point than the usual point free of image retention. The image retention intensity ratio, based on the operation shown in FIGS. 8 and 9, is a measurement by use of the display patterns shown in FIGS. 12A and 12B. Namely, displayed is an image retention print pattern in the form of a horizontal, white strip pattern, as shown in FIG. 12A. Thereafter, a white display pattern having width given by a load of display (display data amount) is displayed vertically 100%, as shown in FIG. 12B. Thus, intensity measurement is made on point A as an image retention point having been displayed by means of the print pattern of FIG. 12A and on point B not having been displayed by the same print pattern. The image retention intensity ratio is calculated by a luminance at point A/luminance at point B. As a result, at any recovering time, when the sustain discharge emission intensity ratio becomes 0.5 or greater or 0.1 or smaller as the load of display changes, the image retention intensity ratio becomes nearly 1 thus not causing an image retention, as shown in FIGS. 13 to 15.

A sustain discharge takes place in two stages of discharge before and after the clamp start timing. As shown in FIGS. 16A to 16C, it spreads partially before the clamp start timing. After the clamp start timing, it again spreads up to an end of the unit cell 5. The sustain discharge is not to spread sufficiently unless there is a certain degree of potential difference within the discharge space. For example, in case discharge initiating threshold voltage Vf is lowered by putting on the unit cell 5, there is an increase in the discharge intensity of before clamp start timing. Thereupon, because wall charges are formed greater in amount before the clamp start timing, there is a corresponding decrease in the potential difference applied in the discharge space when potential is set at a setup voltage in the clamp start timing.

Figure 6:
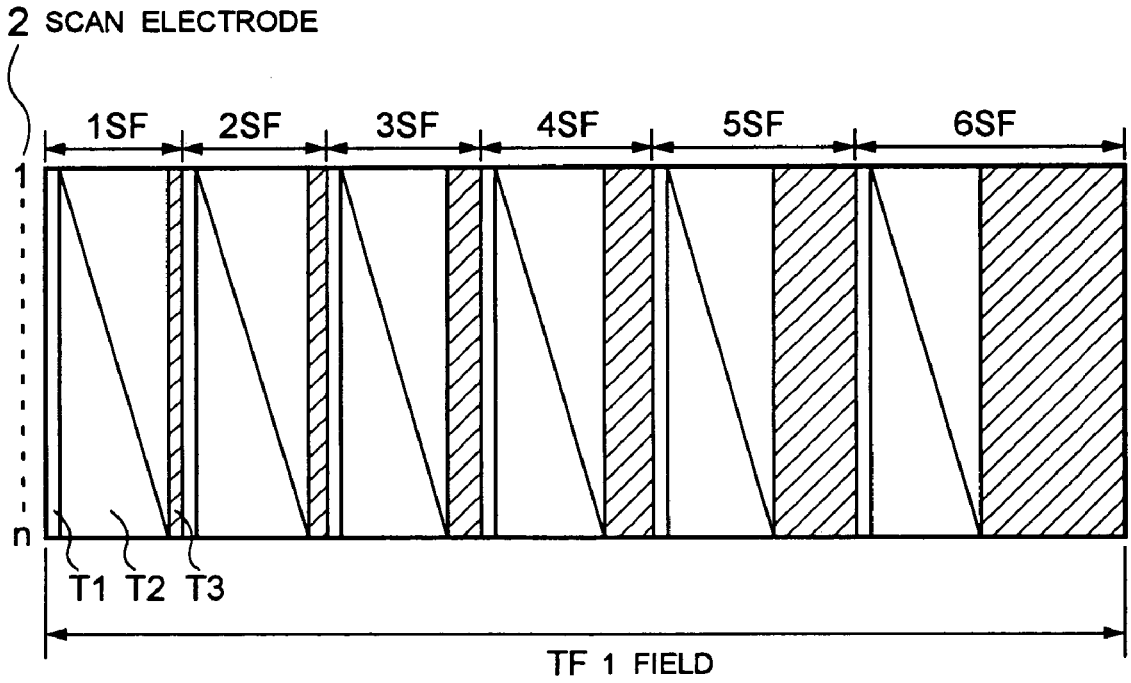
FIG. 6 is a figure explaining the principle of an intensity-level-based display method according to Address Display Separate method used on the FIG. 2 PDP.

In the case of a weak discharge intensity of before clamp start timing, e.g. sustain discharge emission intensity ratio of 0.5 or greater, the discharge space is applied by a potential difference in an amount to spread the discharge up to the end after clamp start timing as shown in FIG. 16A even if the discharge intensity of before clamp start timing is somewhat intensified by drop of the discharge initiating threshold voltage Vf. Contrary to this, where sustain discharge emission intensity ratio is from 0.1 to 0.5, when the discharge intensity of before clamp start trimming increases, the discharge of after the clamp start timing becomes not to spread sufficiently up to the end of the unit cell 5, thus lowering the luminance, as shown in FIG. 6B. Meanwhile, where the sustain discharge emission intensity ratio is 0.1 or smaller, the discharge is spread sufficiently nearly up to the end of the unit cell 5 by the discharge of before clamp start timing as shown in FIG. 16C. Because there are many charge particles within the unit cell 5, the remaining slight discharge becomes a state to sufficiently spread even if the discharge initiating threshold voltage lowers. Thus, luminance does not change, not to cause image retention.

As described above; by providing the sustain discharge emission intensity ratio at 0.5 or greater or 0.1 or smaller, image retention is not allowed to take place. Besides image retention, it is possible to suppress the uneven display due to the variation in the discharge initiating threshold voltage between the unit cells 5, thus enabling display at a uniform brightness. Nevertheless, the sustain discharge emission intensity ratio greatly changes relative to the load of display. With a small load of display, because voltage drop is small in the charge-recovering time period due to a current flow of sustain discharge, the sustain discharge intensity before the clamp start timing increases to correspondingly weaken the sustain discharge intensity of after the clamp start timing. Meanwhile, where load of display is great, discharge current increases to increase the voltage drop.

Consequently, the sustain discharge intensity of before clamp start timing weakens, to correspondingly increase the sustain discharge intensity of after clamp start timing. Accordingly, the sustain discharge emission intensity ratio increases with an increase in load of display, as shown in FIGS. 13 to 15. Accordingly, with one kind of recovering time, there is a difficulty in providing the sustain discharge emission intensity ratio at 0.1 or smaller or 0.5 times or greater over the entire range of load of display. For this reason, as shown in FIG. 17, when the load of display is less than 40%, recovering time is set at 400 μm while, when, the load of display is 40% or greater, the recovering time is set at 500 μm. Due to this, the sustain discharge emission intensity is provided 0.5 or greater or 0.1 or smaller for every value of load of display. This can suppress the occurrence of image retention and the non-uniform display due to variation in the discharge initiating threshold voltage for the unit cell 5, thus effecting display with uniform brightness.

Meanwhile, as shown in FIG. 18, the inductance 121, 124 in the charge recovering circuit 104 is set at a value 1 (corresponding value for comparison) when the load of display is less than 50%, and at a value 2 (corresponding value for comparison) when the load of display is 50% or higher. The value of the inductance 121, 124, can be changed by structuring the inductance 121, 124 with a plurality of inductances in various types and switching those by means of a switch. In case the values of the inductances 121, 124 of the charge recovering circuit 104 change, there is a change in the inclination of voltage change in the charge-recovering time period T31. When the value of the inductance 121, 124 increases, the voltage change is moderated in its inclination, hence delaying the timing of starting a sustain discharge within the charge-recovering time period T31. Consequently, decreased is the sustain discharge emission intensity u of before clamp start timing (charge-recovering time period T31) while increased is the sustain discharge emission intensity v of after clamp start timing (clamp period T32).

Comparing those based on the same load of display as shown in FIGS. 19 and 20, the sustain discharge emission intensity ratio is higher at an inductance value of 2 than at an inductance value of 1. Namely, in FIG. 19, with an inductance value of 1, the sustain discharge emission intensity ratio is 0.1 at a load of display of 57% or lower, wherein the image retention intensity ratio is 1. Meanwhile, in FIG. 20, with an inductance value of 2, the sustain discharge emission intensity ratio is 0.5 or greater at a load of display of 45% or higher, wherein the image retention intensity ratio is 1. In this manner, by switching over the inductance value with the border of a load of display of 50%, it is possible to suppress an image retention and non-uniform display due to the variation in discharge initiating threshold voltage between the unit cells 5, thus effecting display at a uniform brightness.

Figure 21:
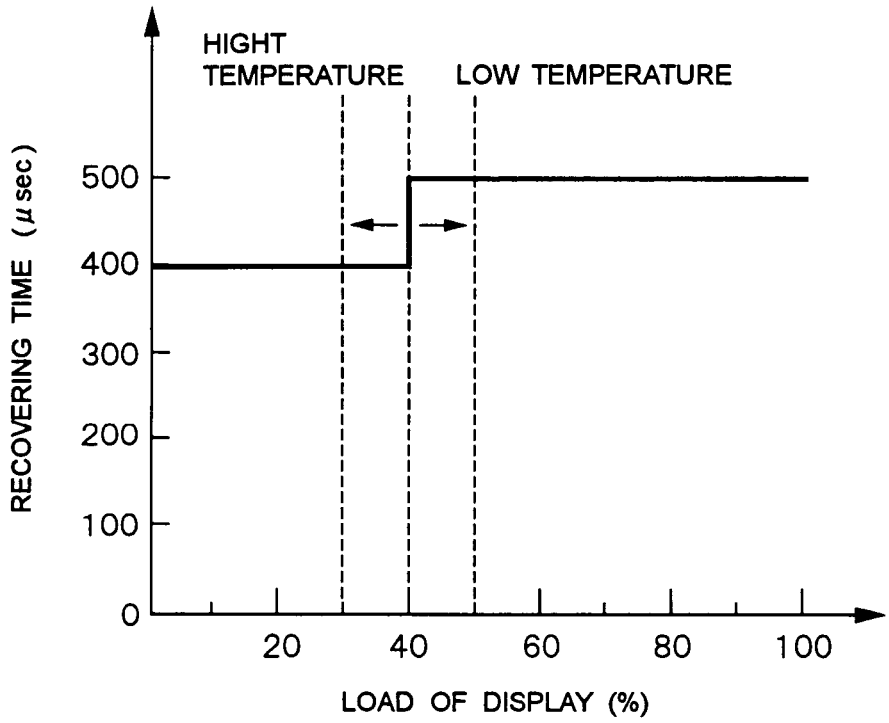
FIG. 21 is a figure showing a relationship between a load of display and a recovering time.

Meanwhile, as shown in FIG. 21, recovering time is set up for a load of display correspondingly to the change of ambient environmental temperature measured by the temperature sensor 113. Namely, at normal temperature at around 25° C. in the ambient environmental temperature, the recovering time is switched over with the boundary of 40% point of the load of display. However, the load of display at which recovering time is switched over is changed correspondingly to the ambient environmental temperature, into, for example, 30% of load of display at high temperature and 50% of load of display at low temperature. In this case, the high temperature is at 40° C. or higher while the low temperature is at 0° C. or lower. Meanwhile, the discharge initiating threshold voltage within the unit cell 5 tends to increase with an increase of temperature. At a high discharge initiating threshold voltage, the occurrence timing of a sustain discharge is delayed within the charge-recovering time period T31, thus decreasing the sustain discharge intensity u of before clamp start timing (charge-recovering time period T31). This increases the sustain discharge emission intensity ratio.

Accordingly, deviated leftward is the curve representing a relationship between a load of display and a sustain discharge emission intensity ratio that is shown in FIGS. 13 to 15. For example, in the case of an ambient environmental temperature of 40° C., the sustain discharge emission intensity with a recovering time of 400 μsec. exceeds 0.1 at a load of display of 35% or over. Conversely, with a recovering time of 500 μsec., the sustain discharge emission intensity ratio exceeds 0.5 at a load of display of 27% or over. From this fact, when the ambient environmental temperature is at 40° C., by changing the load of display at which recovering time is switched over from 40% to 30%, display is available with uniform brightness even where the ambient temperature is 40° C., similarly to that at normal temperature.

Meanwhile, at a low temperature, the curves shown in FIGS. 13 to 15 deviates rightward. For example, in the case of an ambient temperature of 0° C., the sustain discharge emission intensity ratio with a recovering time of 400 μsec. does not exceed 0.1 at a load of display of 53% or lower. Conversely, with a recovering time of 500 μsec., the sustain discharge emission intensity ratio exceeds 0.5 at a load of display of 48% or over. From this fact, when the ambient environmental temperature is at 0° C., by changing the load of display at which recovering time is switched over from 40% to 50%, display is available with uniform brightness even in a low ambient temperature, similarly to that at normal temperature.

Figure 22:
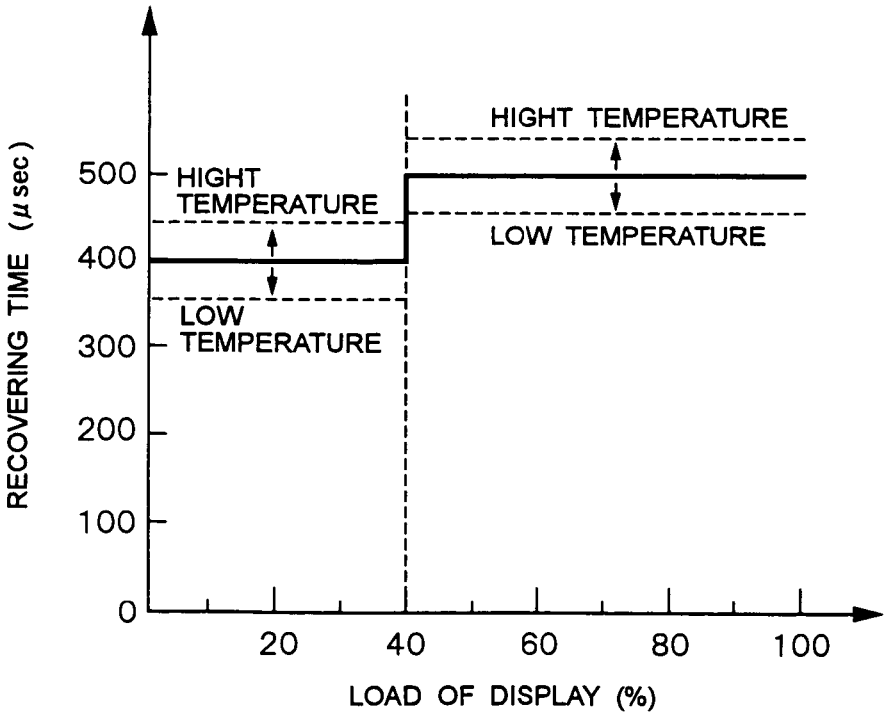
FIG. 22 is a figure showing a relationship between a load of display and a recovering time.

Meanwhile, as shown in FIG. 22, the recovering time for switchover is changed in its value correspondingly to a change in the ambient environmental temperature measured by the temperature sensor 113. Furthermore, the load of display for switching the recovering time is fixed at 40%. Namely, the recovering time is increased correspondingly to a delay in the occurrence timing of a sustain discharge within the charge-recovering time period T31 due to a rise in the discharge initiating threshold voltage within the unit cell 5 at high temperature. Meanwhile, at low temperature, the discharge initiating threshold voltage lowers. Because this advances the occurrence timing of a sustain discharge, the recovering time is made shorter correspondingly. Due to this, sustain discharge emission intensity ratio is obtained at high and low temperatures, similarly to that at normal temperature, thus providing display with uniform brightness free from the occurrence of image retention and non-uniform display.

Figure 23:
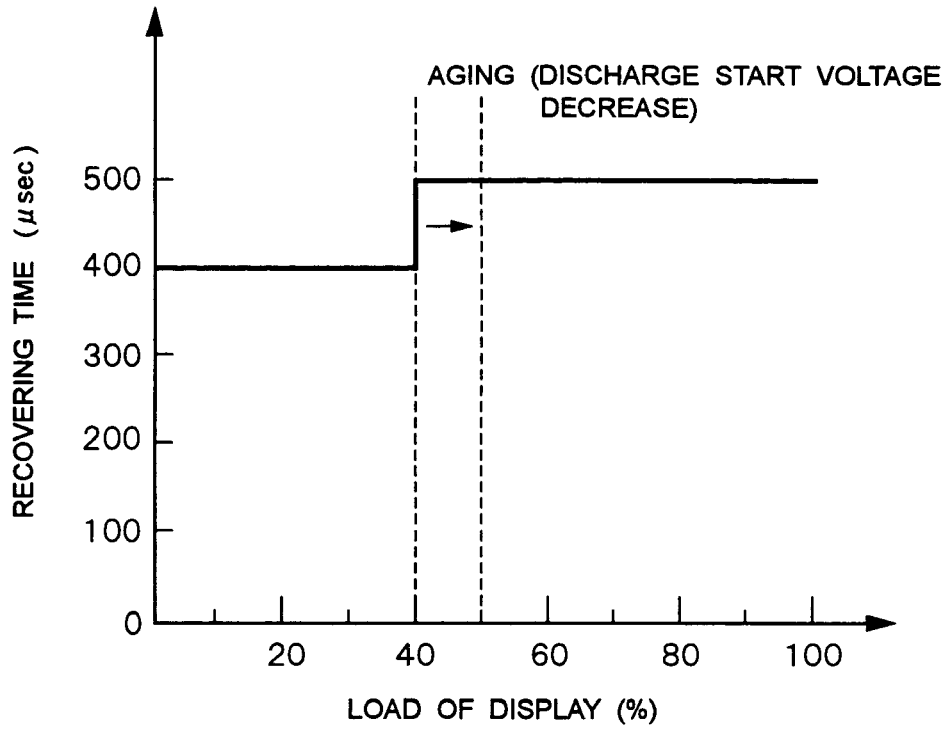
FIG. 23 is a figure showing a relationship between a load of display and a recovering time.

Meanwhile, as shown in FIG. 23, a recovering time is set up for a load of display correspondingly to the use time measured by the timer 114. Namely, the discharge initiating threshold voltage characteristic within the unit cell 5 changes with the time of use from a start of use. The direction with respect to change in discharge initiating threshold voltage (increase or decrease) is different depending upon the specification of PDP 1. However, on the PDPs under a certain unique specification, the change is shown the same. FIG. 23 shows a case that the discharge initiating threshold voltage decreases with use. The decrease in discharge initiating threshold voltage with the passage of use time is similar in change to the decrease in discharge initiating threshold voltage due to a lowering in temperature. Accordingly, the load of display for switching the recovering time is taken greater together with the time of use, similarly to the low-temperature case. Due to this, even where discharge initiating threshold voltage decreases due to aging, display with uniform brightness is obtained freely from the occurrence of image retention and non-uniform display.

Incidentally, where the discharge initiating threshold voltage increases with use, similar merits are obtained by decreasing the load of display for switching the recovering time together with the time of use. Meanwhile, where the change direction in discharge initiating threshold voltage changes in the course, similar merits are obtained by changing the load of display for switching the recovering time in a manner corresponding to that change.

Figure 24:
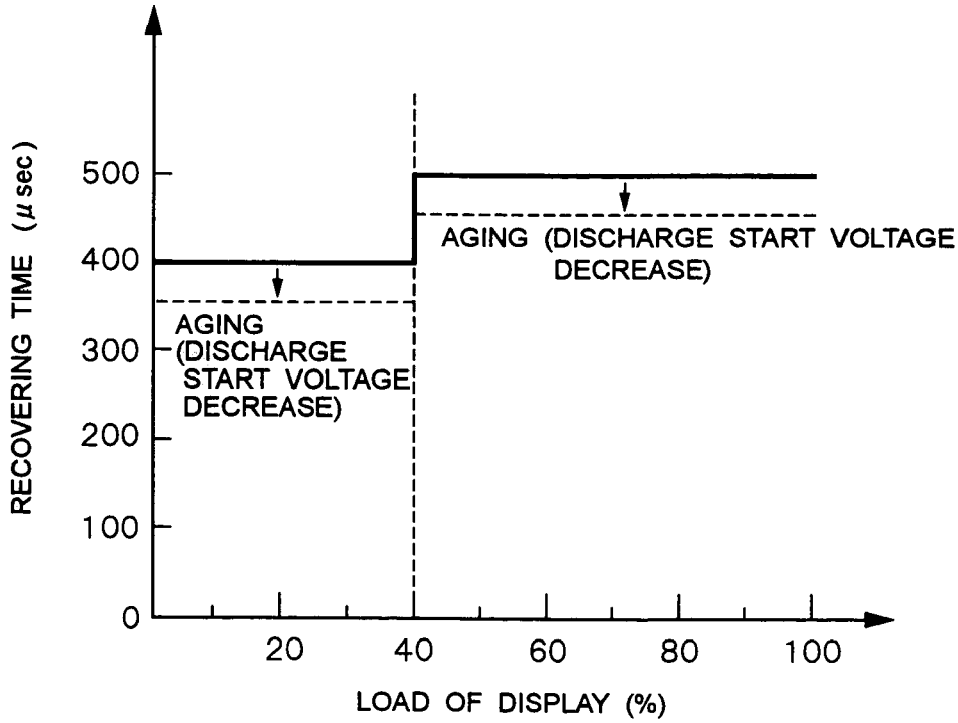
FIG. 24 is a figure showing a relationship between a load of display and a recovering time.

Meanwhile, as shown in FIG. 24, the recovering time to be switched is changed in time correspondingly to the time of use measured by the timer 114 and further the load of display for switching the recovering time is fixed at 40%, for example. In FIG. 24, there is also shown a case the discharge initiating threshold voltage lowers with use. Namely, the load of display at which the recovering time is switched is constant but the recovering time is changed in value. When the discharge initiating threshold voltage decreases due to aging, change is toward shortening the recovering time.

Figure 25:
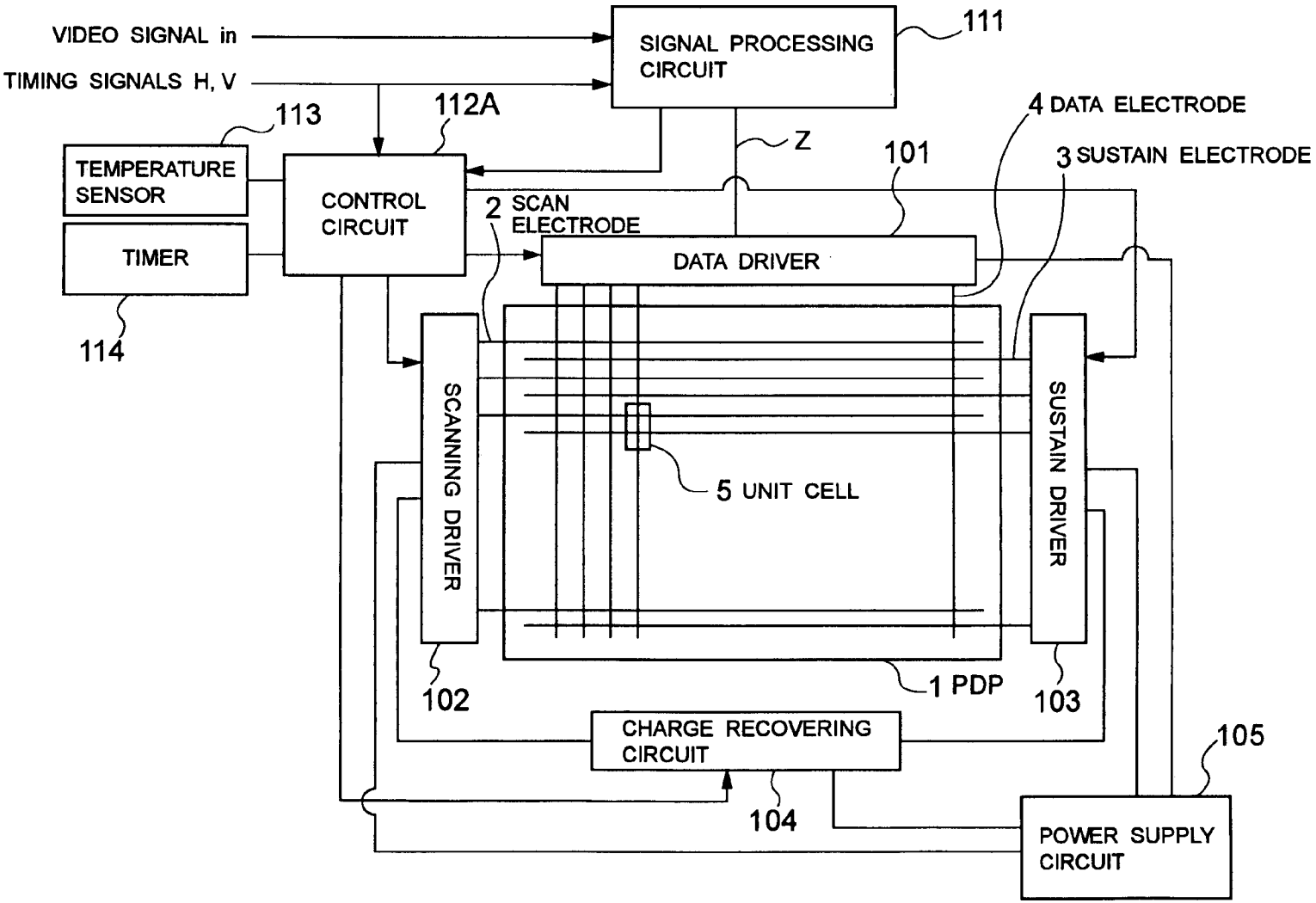
FIG. 25 is a block diagram showing an electric arrangement of a plasma display in a second embodiment of the invention.

FIG. 25 is a block diagram showing an electric configuration of a plasma display in a second embodiment of the invention. The common references are attached to the common elements to the elements in FIG. 10 showing the first embodiment.

This plasma display is provided with a control circuit 112A having a different function in place of the FIG. 10 control circuit 112, as shown in FIG. 25. The control circuit 112A is to control the operation timing of a data driver 101, scanning driver 102, sustain driver 103 and charge recovering circuit 104 similarly to the control circuit 112, to thereby control the input of a voltage generated in a power supply, circuit 105. Particularly, in this embodiment, the control circuit 112A sets, for every sustain pulse, in the charge recovering circuit 104, a charge restore time period for recovering the charge on the capacitance component of the PDP 1 and a clamp timing period for applying a predetermined sustain voltage to the sustain electrodes 3 and scan electrodes 2 after the charge restore time period through a clamp start timing. Furthermore, it sets a sustain discharge emission crest value ratio as a ratio of a crest value of discharge emission waveform in the clamp timing period to a crest value of discharge emission waveform in the charge-recovering time period, smaller than 1.

Figure 26:
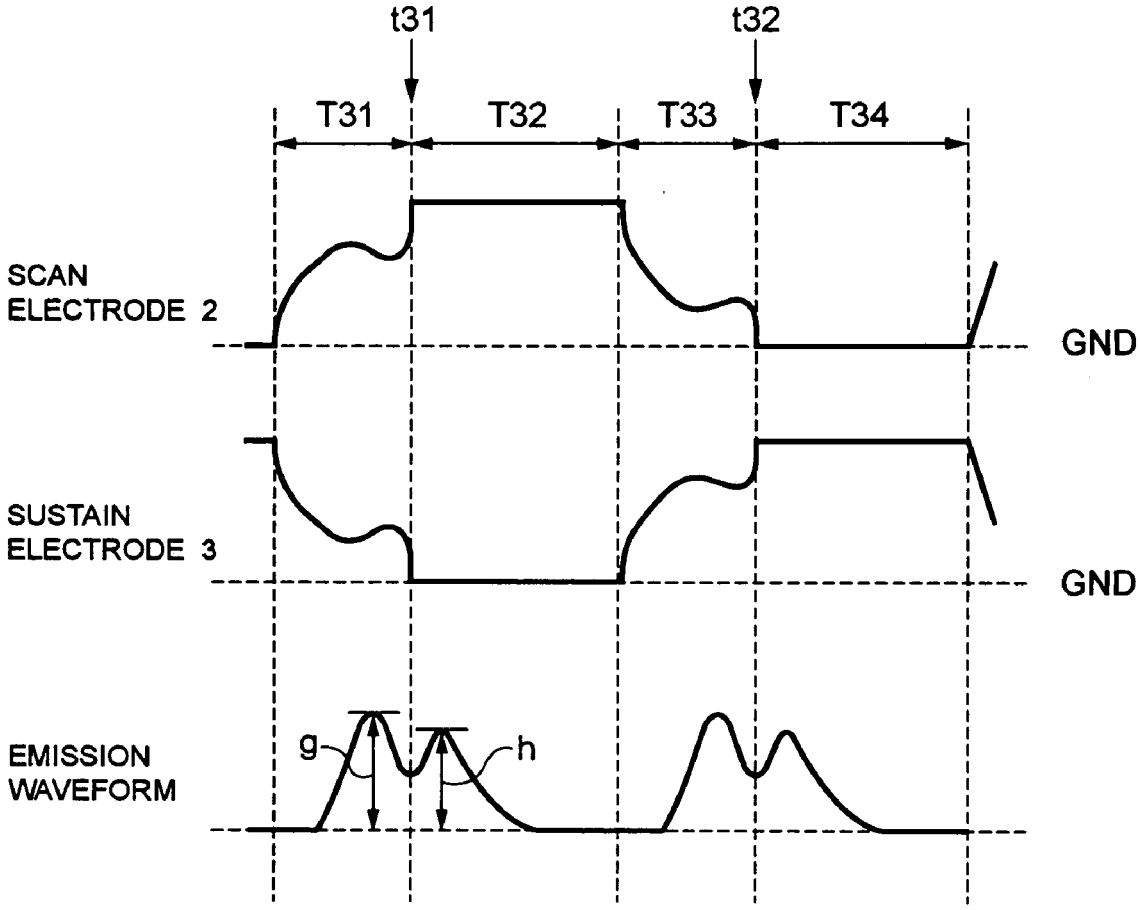
FIG. 26 is a figure showing an application voltage waveform to the scan electrode 2 and sustain electrode 3 in FIG. 25 and an emission waveform due to sustain discharge.
Figure 27A:
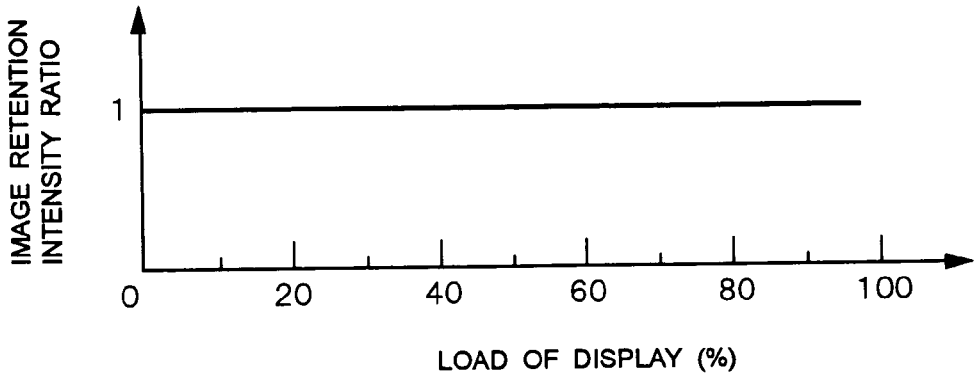
FIG. 27 is a figure showing a relationship between a load of display, an image retention intensity ratio, a sustain discharge emission intensity ratio and a sustain discharge emission crest value ratio.
Figure 27B:
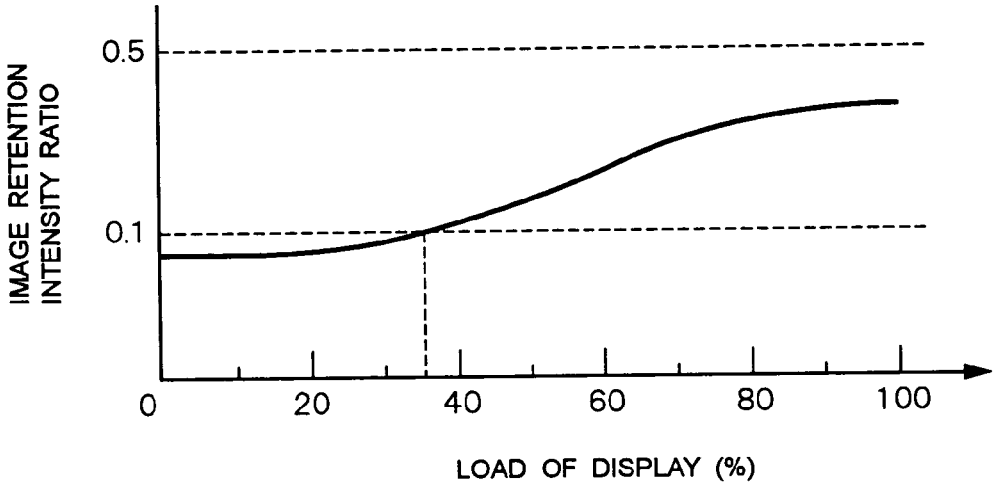
Figure 27C:
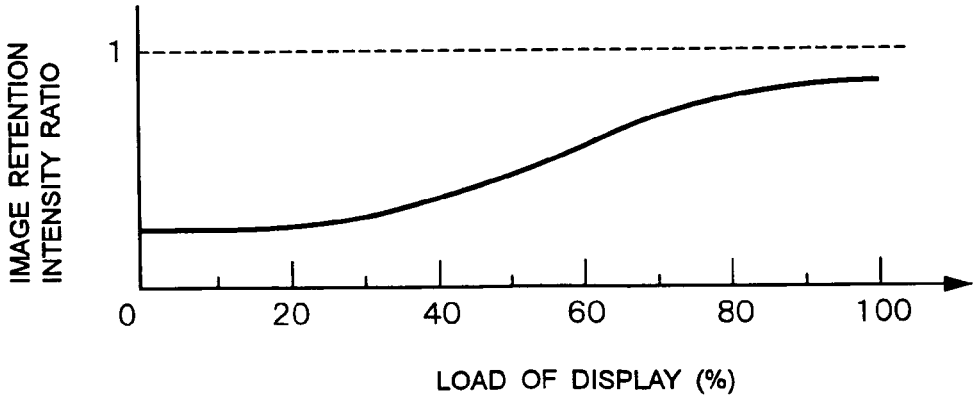

FIG. 26 is a figure showing an application voltage waveform to the scan electrode 2 and sustain electrode 3 in FIG. 25, and an emission waveform based on sustain discharge. FIGS. 27A to 27C are figures showing a relationship between a load of display and an image retention intensity ratio, a sustain discharge emission intensity ratio and a sustain discharge emission crest value ratio, respectively.

Referring to those figures, explanation is made on the processing as to a drive method to be used for the plasma display of this embodiment.

In this plasma display, for every sustain pulse, a charge-recovering time period for recovering the charge on the capacitance component of the PDP 1 and a clamp timing period for applying a predetermined sustain voltage to the sustain electrodes 3 and scan electrodes 2 after the charge-recovering time period for recovering the capacitance component charge of PDP 1 through a clamp start timing of after the charge-recovering time period are set. Furthermore, it sets a sustain discharge emission crest value ratio as a ratio of a crest value of discharge emission waveform in the clamp timing period to a crest value of discharge emission waveform in the charge-recovering time period, smaller than 1.

Namely, in FIG. 26, the clamp start timing t31 is fixed and the recovering time (charge-recovering time period T31) is set at 600 μsec., and therefore the recovering time is greater as compared to that in FIG. 17 (recovering time: 400 μsec., 500 μsec.) in the first embodiment. As shown in (c) in FIG. 26, because the emission waveform is separated between a discharge of before clamp start timing t31 (charge-recovering time period T31) and a discharge of after the clamp start timing t31 (clamp timing period T32), the discharge of after the clamp start timing (clamp timing period T32) takes place after a considerable weakening of the discharge of before clamp start timing (charge-recovering time period T31). Consequently, the sustain discharge emission crest value ratio (=discharge crest value h in the clamp timing period T32/discharge crest value g in the charge-recovering time period T31) is smaller than 1, as shown in FIG. 27C. In case the sustain discharge emission crest value ratio is smaller than 1, the discharge of before clamp start timing (charge-recovering time period T31) prevails whereby luminance is mainly decisive by the discharge of before clamp start timing. Accordingly, the sustain discharge emission intensity ratio lies between 0.1 and 0.5 in a load-of-display range of approximately 35% and over, as shown in FIG. 27B. However, the image retention intensity ratio is always 1, thus not causing image retention. Meanwhile, suppressed is the display non-uniformity due to the variation in discharge initiating threshold voltage.

As described above, in the second embodiment, because the sustain discharge emission intensity ratio is set smaller than 1, no image retention takes place. Furthermore, suppressed is the display non-uniformity due to the variation in discharge initiating threshold voltage.

Although the embodiments of the invention have been detailed so far, the detailed structure thereof is not limited to the same embodiment. Design modification, if made within a range not departing from the gist of the invention, is to be included in the invention.

For example, the charge recovering circuit 104 may be configured with inductances, to be controlled by the control circuit 112, in place of the inductances 61, 64, 71, 74, for example. Meanwhile, although in the first embodiment binary or ternary values were set for the load of display, the ambient environmental temperature, the time of use and so on in switching over the recovering time or the inductance value, much more values for switchover can be set to suppress the brightness change to a small in the switchover.

Meanwhile, in the second embodiment, the control circuit 112A may control the sustain discharge emission crest value ratio according to the image retention intensity ratio as a ratio of a luminance at a point where luminance is changed by an image retention to a luminance at a point where there is no image retention of PDP1 display pattern, the load of display as to each sub-field, the change in discharge initiating threshold voltage within the unit cell 5, the ambient environmental temperature detected by the temperature sensor 113 or the time of use measured by the timer 114. Meanwhile, the control circuit 112A may change the sustain discharge emission crest value ratio by changing the time width of the charge-recovering time period and clamp timing period. Meanwhile, the control circuit 112A may control the sustain discharge emission crest value ratio by changing the inductance of the charge recovering circuit 104.

This invention is applicable to the whole range of plasma displays using the Address Display Separate method that each sub-field is separated as a scanning time period and a sustaining time period.

This application is based on Japanese Patent Application No. 2004-273718 which is hereby incorporated by reference.

What is claimed is:

1. A plasma display comprising:

a plasma display panel; and a driving section for driving the plasma display panel by segmenting one field of display screen into a plurality of sub-fields weighted based on intensity level;

the plasma display panel having first and second substrates arranged opposite to each other;

a plurality of surface-discharge electrode pairs formed with scan electrodes and sustain electrodes that are arranged parallel one with another with a discharge gap, on an opposed surface of the first substrate to the second substrate;

a plurality of data electrodes provided in a form intersecting with the surface-discharge electrode pairs, on an opposed surface of the second substrate to the first substrate;

a plurality of unit cells formed at intersections of the plurality of surface-discharge electrode pairs and the plurality of data electrodes;

a discharge gas filled between the first substrate and the second substrate, including an interior of the unit cells;

a first dielectric layer covering the plurality of surface-discharge electrode pairs; and a second dielectric layer covering the plurality of data electrodes;

the driving section setting a scanning time period for applying, line-sequentially for every sub-field, a scan pulse to the scan electrodes and, simultaneously, applying a display data pulse synchronous with the scan pulse to the data electrodes, thereby selecting a unit cell and causing a write discharge in the selected unit cell, and a sustaining time period for applying a sustain pulse alternately to the sustain electrodes and the scan electrodes and causing a sustain discharge within the unit cells;

wherein a sustain-discharge emission intensity ratio control section is provided to set, for every pulse, a charge-recovering time period for recovering a charge on a capacitance component of the plasma display panel and a clamp timing period for applying a predetermined sustain voltage to the sustain electrodes or the scan electrodes after the charge-recovering time period through clamp start timing, and to set a sustain-discharge emission intensity ratio, as a ratio of a maximal discharge intensity in the clamp timing period with reference to a discharge intensity in the clamp start timing to a maximum discharge intensity in the charge-recovering time period, at a value that a discharge in the clamp timing period is to spread up to an end of the unit cell.

2. A plasma display according to claim 1, wherein the sustain-discharge emission intensity ratio control section is configured to set the sustain-discharge emission intensity ratio substantially at 0.5 or greater or 0.1 or smaller.

3. A plasma display according to claim 1, wherein the sustain-discharge emission intensity ratio control section is configured to control the sustain-discharge emission intensity ratio correspondingly to an image retention intensity ratio as a ratio of a luminance at a point where luminance changed by image retention to a luminance at a point on the plasma display panel where there are no image retention of a display pattern.

4. A plasma display according to claim 1, wherein the sustain-discharge emission intensity ratio control section is configured to control the sustain-discharge emission intensity ratio correspondingly to a load of display over the sub-fields.

5. A plasma display according to claim 1, wherein the sustain-discharge emission intensity ratio control section is configured to control the sustain-discharge emission intensity ratio correspondingly to a change in discharge initiating threshold voltage for the unit cells.

6. A plasma display according to claim 1, wherein the sustain-discharge emission intensity ratio control section is configured to control the sustain-discharge emission intensity ratio correspondingly to an ambient environmental temperature of the plasma display.

7. A plasma display according to claim 1, wherein the sustain-discharge emission intensity ratio control section is configured to control the sustain-discharge emission intensity ratio correspondingly to a time of use of the plasma display from a start of use thereof.

8. A plasma display according to claim 4, wherein the sustain-discharge emission intensity ratio control section is configured to set the sustain-discharge emission intensity ratio substantially at 0.5 or greater or 0.1 or smaller when the load of display over the sub-fields is 100%.

9. A plasma display according to claim 1, wherein the sustain-discharge emission intensity ratio control section is configured to control the sustain-discharge emission intensity ratio by changing the clamp start timing in a position-in-time.

10. A plasma display according to claim 1, wherein the sustain-discharge emission intensity ratio control section has an inductance for recovering a charge on a capacitance component of the plasma display panel, and is configured to control the sustain-discharge emission intensity ratio by changing the inductance.

11. A plasma display comprising:

a plasma display panel; and a driving section for driving the plasma display panel by segmenting one field of display screen into a plurality of sub-fields weighted based on intensity level;

the plasma display panel having first and second substrates arranged opposite to each other;

a plurality of surface-discharge electrode pairs formed with scan electrodes and sustain electrodes that are arranged parallel one with another with a discharge gap, on an opposed surface of the first substrate to the second substrate;

a plurality of data electrodes provided in a form intersecting with the surface-discharge electrode pairs, on an opposed surface of the second substrate to the first substrate;

a plurality of unit cells formed at intersections of the plurality of surface-discharge electrode pairs and the plurality of data electrodes;

a discharge gas filled between the first substrate and the second substrate, including an interior of the unit cells;

a first dielectric layer covering the plurality of surface-discharge electrode pairs; and a second dielectric layer covering the plurality of data electrodes;

the driving section setting a scanning time period for applying, line-sequentially for every sub-field, a scan pulse to the scan electrodes and, simultaneously, applying a display data pulse synchronous with the scan pulse to the data electrodes, thereby selecting a unit cell and causing a write discharge in the selected unit cell, and a sustaining time period for applying a sustain pulse alternately to the sustain electrodes and the scan electrodes and causing a sustain discharge within the unit cells;

wherein a sustain-discharge emission intensity ratio control section is provided to set, for every pulse, a charge-recovering time period for recovering a charge on a capacitance component of the plasma display panel and a clamp timing period for applying a predetermined sustain voltage to the sustain electrodes or the scan electrodes after the charge-recovering time period through clamp start timing, and to set a sustain-discharge emission crest value ratio, as a ratio of a crest value of a discharge emission waveform in the clamp timing period to a crest value of a discharge emission waveform in the charge-recovering time period, smaller than 1.

12. A plasma display according to claim 11, wherein the sustain-discharge emission intensity ratio control section is configured to control the sustain-discharge emission intensity ratio correspondingly to an image retention intensity ratio as a ratio of a luminance at a point where luminance changed by image retention to a luminance at a point on the plasma display panel where there are no image retention of a display pattern.

13. A plasma display according to claim 11, wherein the sustain-discharge emission intensity ratio control section is configured to control the sustain-discharge emission intensity ratio correspondingly to a load of display over the sub-fields.

14. A plasma display according to claim 11, wherein the sustain-discharge emission intensity ratio control section is configured to control the sustain-discharge emission intensity ratio correspondingly to a change in discharge initiating threshold voltage for the unit cells.

15. A plasma display according to claim 11, wherein the sustain-discharge emission intensity ratio control section is configured to control the sustain-discharge emission intensity ratio correspondingly to an ambient environmental temperature of the plasma display.

16. A plasma display according to claim 11, wherein the sustain-discharge emission intensity ratio control section is configured to control the sustain-discharge emission intensity ratio correspondingly to a time of use of the plasma display from a start of use thereof.

17. A plasma display according to claim 11, wherein the sustain-discharge emission intensity ratio control section is configured to control the sustain-discharge emission intensity ratio by changing the clamp start timing in a position-in-time.

18. A plasma display according to claims 11, wherein the sustain-discharge emission intensity ratio control section has an inductance for recovering a charge on a capacitance component of the plasma display panel, and is configured to control the sustain-discharge emission intensity ratio by changing the inductance.

19. A drive method for use on a plasma display, the plasma display comprising:

a plasma display panel; and a driving section for driving the plasma display panel by segmenting one field of display screen into a plurality of sub-fields weighted based on intensity level;

the plasma display panel having first and second substrates arranged opposite to each other;

a plurality of surface-discharge electrode pairs formed with scan electrodes and sustain that are arranged parallel one with another with a discharge gap, on an opposed surface of the first substrate to the second substrate;

a plurality of data electrodes provided in a form intersecting with the surface-discharge electrode pairs, on an opposed surface of the second substrate to the first substrate;

a plurality of unit cells formed at intersections of the plurality of surface-discharge electrode pairs and the plurality of data electrodes;

a discharge gas filled between the first substrate and the second substrate, including an interior of the unit cells;

a first dielectric layer covering the plurality of surface-discharge electrode pairs; and a second dielectric layer covering the plurality of data electrodes;

the driving section setting a scanning time period for applying, line-sequentially for every sub-field, a scan pulse to the scan electrodes and, simultaneously, applying a display data pulse synchronous with the scan pulse to the data electrodes, thereby selecting a unit cell and causing a write discharge in the selected unit cell, and a sustaining time period for applying a sustain pulse alternately to the sustain electrodes and the scan electrodes and causing a sustain discharge within the unit cells; the method characterized by:

setting, for every pulse, a charge-recovering time period for recovering a charge on a capacitance component of the plasma display panel and a clamp timing period for applying a predetermined sustain voltage to the sustain electrodes or the scan electrodes after the charge-recovering time period through clamp start timing, and to set a sustain-discharge emission intensity ratio, as a ratio of a maximal discharge intensity in the clamp timing period with reference to a discharge intensity in the clamp start timing to a maximum discharge intensity in the charge-recovering time period, at a value that a discharge in the clamp timing period is to spread up to an end of the unit cell.

20. A drive method for use on a plasma display, the plasma display comprising:

a plasma display panel; and a driving section for driving the plasma display panel by segmenting one field of display screen into a plurality of sub-fields weighted based on intensity level;

the plasma display panel having first and second substrates arranged opposite to each other;

a plurality of surface-discharge electrode pairs formed with scan electrodes and sustain electrodes that are arranged parallel one with another with a discharge gap, on an opposed surface of the first substrate to the second substrate;

a plurality of data electrodes provided in a form intersecting with the surface-discharge electrode pairs, on all opposed surface of the second substrate to the first substrate;

a plurality of unit cells formed at intersections of the plurality of surface-discharge electrode pairs and the plurality of data electrodes;

a discharge gas filled between the first substrate and the second substrate, including an interior of the unit cells;

a first dielectric layer covering the plurality of surface-discharge electrode pairs; and a second dielectric layer covering the plurality of data electrodes;

the driving section setting a scanning time period for applying, line-sequentially for every sub-field, a scan pulse to the scan electrodes and, simultaneously, a display data pulse synchronous with the scan pulse to the data electrodes, thereby selecting a unit cell and causing a write discharge in the selected unit cell, and a sustaining time period for applying a sustain pulse alternately to the sustain electrodes and the scan electrodes and causing a sustain discharge within the unit cells; the method characterized by:

setting, for every pulse, a charge-recovering time period for recovering a charge on a capacitance component of the plasma display panel and a clamp timing period for applying a predetermined sustain voltage to the sustain electrodes or the scan electrodes after the charge-recovering time period through clamp start timing, and to set a sustain-discharge emission crest value ratio, as a ratio of a crest value of a discharge emission waveform in the clamp timing period to a crest value of a discharge emission waveform in the charge-recovering time period, smaller than 1.

* * * * *